US010618276B2

(12) United States Patent
Katakura et al.

(10) Patent No.: US 10,618,276 B2
(45) Date of Patent: Apr. 14, 2020

(54) CONTROLLING EJECTION NOZZLES AND NON-EJECTION NOZZLES SEPARATELY IN MULTIPLE STATES

(71) Applicant: SEIKO EPSON CORPORATION, Tokyo (JP)

(72) Inventors: Takahiro Katakura, Okaya (JP); Keigo Sugai, Chino (JP); Hirofumi Sakai, Shiojiri (JP); Shinichi Nakamura, Okaya (JP); Junichi Sano, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/201,886

(22) Filed: Nov. 27, 2018

(65) Prior Publication Data

US 2019/0160810 A1 May 30, 2019

(30) Foreign Application Priority Data

Nov. 28, 2017 (JP) ..... 2017-227395

(51) Int. Cl.
*B41J 2/045* (2006.01)
*B41J 2/14* (2006.01)

(52) U.S. Cl.
CPC ..... *B41J 2/0451* (2013.01); *B41J 2/04581* (2013.01); *B41J 2/14201* (2013.01); *B41J 2202/05* (2013.01)

(58) Field of Classification Search
CPC .. B41J 2/0451; B41J 2/04581; B41J 2202/05; B41J 2/14201
See application file for complete search history.

(56) References Cited

U.S. PATENT DOCUMENTS

2007/0279460 A1* 12/2007 Yokoyama ..... B41J 2/14274 347/71

FOREIGN PATENT DOCUMENTS

| | | | |
|---|---|---|---|
| JP | 62-225364 | A | 10/1987 |
| JP | 2007-320042 | A | 12/2007 |
| JP | 2010-274446 | A | 12/2010 |

(Continued)

*Primary Examiner* — Bradley W Thies
(74) *Attorney, Agent, or Firm* — Workman Nydegger

(57) ABSTRACT

A liquid ejecting apparatus includes a plurality of nozzles, a plurality of pressure chambers, a plurality of pressure-generation-elements, a plurality of inflow channels, a first-channel-resistance-changing-section, and a control-unit. The control-unit repeats control of switching between a first state in which the control-unit controls the first-channel-resistance-changing-section to collectively increase channel resistance of the inflow channels and a second state in which the control-unit controls the first-channel-resistance-changing-section to collectively decrease the channel resistance of the inflow channels. The control-unit, with respect to a pressure-generation-element corresponding to an ejection nozzle, performs ejection control including extrusion control to reduce the volume of the pressure chamber in the first state, and with respect to a pressure-generation-element corresponding to a non-ejection nozzle, the control-unit performs non-ejection control including intake and exhaust control in which the volume of the pressure chamber is expanded in the first state and is reduced in the second state.

7 Claims, 16 Drawing Sheets

(56) References Cited

FOREIGN PATENT DOCUMENTS

| | | | |
|---|---|---|---|
| JP | 2015-112838 | A | 6/2015 |
| JP | 2017-094691 | A | 6/2017 |

* cited by examiner

CONTROLLING EJECTION NOZZLES AND NON-EJECTION NOZZLES SEPARATELY IN MULTIPLE STATES

BACKGROUND

1. Technical Field

The present invention relates to liquid ejecting apparatuses.

2. Related Art

With regard to liquid ejecting apparatuses, for example, JP-A-2007-320042 discloses a liquid ejecting apparatus provided with a plurality of nozzles, a plurality of pressure chambers communicating with the nozzles, a plurality of supply channels for supplying liquid to the pressure chambers, and a resistance varying scheme configured to vary fluid resistance within each of the supply channels at the same time. In this liquid ejecting apparatus, the resistance varying scheme is used to change settings of an ejection speed, ejection amount, and the like of the liquid.

In the liquid ejecting apparatus described in JP-A-2007-320042, there is a case in which the liquid is supplied to the pressure chamber by pressurization from the supply channel side in order to increase a liquid filling speed or the like. In this case, since the pressurized liquid is supplied to each of the supply channels from a shared liquid supply chamber, the liquid is supplied not only to the nozzle having ejected the liquid, but also to the nozzle not having ejected the liquid. As a result, there arises a risk of liquid leakage from the nozzle not having ejected the liquid. In particular, in a case where a thick liquid is ejected at a high frequency, the above-mentioned problem becomes conspicuous because the pressure applied to the liquid is large.

SUMMARY

The invention has been contrived to solve at least part of the above-mentioned problem, and can be achieved as the following aspects.

1. A liquid ejecting apparatus is provided according to an aspect of the invention. The stated liquid ejecting apparatus includes: a plurality of nozzles for ejecting a liquid; a plurality of pressure chambers communicating with the nozzles; a plurality of pressure generation elements provided on the plurality of pressure chambers and configured to change volumes of the pressure chambers; a plurality of inflow channels connected to the pressure chambers and configured to allow the liquid to enter the pressure chambers; a first channel resistance changing section to collectively change channel resistance of each of the inflow channels; a pressurizing unit configured to pressurize and supply the liquid to the inflow channels; and a control unit to control the first channel resistance changing section and the pressure generation elements. The control unit repeats control of switching between a first state in which the control unit controls the first channel resistance changing section to collectively increase the channel resistance of the plurality of inflow channels and a second state in which the control unit controls the first channel resistance changing section to collectively make the channel resistance of the plurality of inflow channels smaller than the channel resistance thereof in the first state; the control unit, with respect to an pressure generation element as the above-mentioned pressure generation element corresponding to an ejection nozzle to eject the liquid among the plurality of nozzles, performs ejection control including extrusion control in which the control unit controls the pressure generation element to reduce the volume of the pressure chamber in the first state; and with respect to a non-pressure generation element as the pressure generation element corresponding to a non-ejection nozzle not to eject the liquid among the plurality of nozzles, the control unit performs non-ejection control including intake and exhaust control in which the control unit controls the non-pressure generation element to expand the volume of the pressure chamber in the first state, and controls the non-pressure generation element to reduce the volume of the pressure chamber in the second state. According to the liquid ejecting apparatus of this aspect, since the volume of the pressure chamber corresponding to the non-ejection nozzle is expanded in the first state, the air is sucked through the nozzle and a meniscus is formed, and since the volume of the pressure chamber corresponding to the non-ejection nozzle is reduced in the second state, the liquid in the pressure chamber flows to the inflow channel. Accordingly, by the first channel resistance changing section collectively decreasing the channel resistance of the plurality of inflow channels, the leakage of liquid from the non-ejection nozzle can be suppressed even if the pressurized liquid is supplied to both the pressure chamber corresponding to the ejection nozzle and the pressure chamber corresponding to the non-ejection nozzle.

2. In the liquid ejecting apparatus of the above aspect, the control unit may expand the volume of the pressure chamber corresponding to the non-ejection nozzle in the non-ejection control, after having reduced the volume of the pressure chamber corresponding to the ejection nozzle in the ejection control. According to the liquid ejecting apparatus of this aspect, the control unit can reduce the volume of the pressure chamber corresponding to the ejection nozzle and can expand the volume of the pressure chamber corresponding to the non-ejection nozzle at different timings. Because of this, the leakage of liquid from the non-ejection nozzle can be suppressed without precisely controlling the timings of changing the volumes of the respective pressure chambers.

3. In the liquid ejecting apparatus of the above aspect, the control unit, when performing the ejection control and the non-ejection control, may switch twice from the first state to the second state; the control unit may control, in the ejection control, the pressure generation element to expand the volume of the pressure chamber in the earlier first state prior to the extrusion control and may perform the extrusion control in the later first state; and the control unit may perform, in the non-ejection control, the intake and exhaust control in a period of time from the earlier first state to the earlier second state and may perform the intake and exhaust control again in a period of time from the later first state to the later second state. According to the liquid ejecting apparatus of this aspect, at the time of ejecting the liquid from the ejection nozzle, because the state of the volume within the pressure chamber is shifted from being expanded to being reduced by the pressure generation element, a large change in volume of the pressure chamber can be obtained in comparison with a case of shifting the state of the volume within the pressure chamber from an initial state to the reduced state. This makes it possible to increase the amount of liquid ejected from the nozzle.

4. The liquid ejecting apparatus of the above aspect further includes a plurality of outflow channels connected to the pressure chambers and configured to allow the liquid to flow out from the pressure chambers, and a second channel resistance changing section to collectively change channel resistance of each of the outflow channels. The control unit may repeat control of switching between a third state in which the control unit controls the second channel resistance changing section to collectively increase the channel resistance of the plurality of outflow channels and a fourth state in which the control unit controls the second channel resistance changing section to collectively make the channel resistance of the plurality of outflow channels smaller than the channel resistance thereof in the third state. According to the liquid ejecting apparatus of this aspect, the channel resistance of the outflow channel is increased by the control unit controlling the second channel resistance changing section, at the time of ejecting the liquid from the nozzle. Because of this, a situation in which the pressure inside the pressure chamber is released through the outflow channel can be suppressed, so that a failure of liquid ejection from the nozzle can be suppressed.

5. In the liquid ejecting apparatus of the above aspect, the control unit may control, in the ejection control, the pressure generation element to reduce the volume of the pressure chamber at the timings of the first state and the third state; and in the non-ejection control, the control unit may control the non-pressure generation element to expand the volume of the pressure chamber at the timings of the first state and the third state, and may control the non-pressure generation element to reduce the volume of the pressure chamber at the timing of the second or fourth state. According to the liquid ejecting apparatus of this aspect, since the volume of the pressure chamber corresponding to the non-ejection nozzle is expanded at the timings of the first and third states, the air is sucked through the nozzle and a meniscus is formed, and since the volume of the pressure chamber corresponding to the non-ejection nozzle is reduced at the timing of the second or fourth state, the liquid in the pressure chamber flows to the inflow channel or to the outflow channel. Accordingly, by the first channel resistance changing section collectively decreasing the channel resistance of the plurality of inflow channels, the leakage of liquid from the non-ejection nozzle can be suppressed even if the pressurized liquid is supplied to both the pressure chamber corresponding to the ejection nozzle and the pressure chamber corresponding to the non-ejection nozzle.

6. In the liquid ejecting apparatus of the above aspect, the control unit can output a signal of expansion to the pressure generation element to make the volume of the pressure chamber be in an expanded state, and a signal of reduction to the pressure generation element to make the volume of the pressure chamber be in a reduced state; and the control unit may cause the volume of the pressure chamber to be expanded by supplying the signal of expansion to the pressure generation element or by stopping the supply of the signal of reduction to the pressure generation element, and may cause the volume of the pressure chamber to be reduced by supplying the signal of reduction to the pressure generation element or by stopping the supply of the signal of expansion to the pressure generation element. According to the liquid ejecting apparatus of this aspect, the control unit controls the supply of the signals to the pressure generation element so as to expand or contract the pressure generation element, thereby making it possible to change the volume of the pressure chamber.

The invention can also be implemented in various aspects other than the liquid ejecting apparatus. For example, the invention can be implemented in the aspects such as a liquid ejecting method, a computer program to control a liquid ejecting apparatus, and a permanent and tangible recording medium on which the above computer program is recorded.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
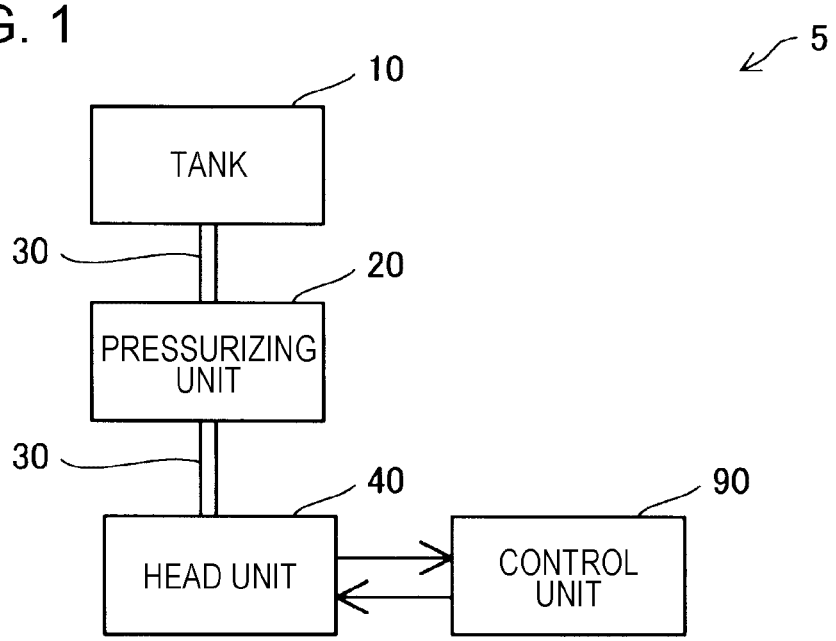
FIG. 1 is a descriptive diagram illustrating a general structure of a liquid ejecting apparatus according to a first embodiment.

FIG. 1 is a descriptive diagram illustrating a general structure of a liquid ejecting apparatus 5 according to a first embodiment. The liquid ejecting apparatus 5 includes a tank 10, a pressurizing unit 20, a supply channel 30, a head unit 40, and a control unit 90.

The tank 10 accommodates a liquid. As the liquid, for example, ink having a predetermined viscosity is accommodated. The liquid in the tank 10 is pressurized by the pressurizing unit 20, and supplied to the head unit 40 through the supply channel 30. The pressurizing unit 20 of the present embodiment is a metering pump capable of supplying the liquid at a constant flow rate. A gear pump with few pulsations can be used as the metering pump. In addition, for example, in a case where a buffer tank for absorbing pulsations is provided in part of the supply channel 30, various types of metering pumps such as a diaphragm-type pump and a plunger-type pump can also be used.

A liquid supplied to the head unit 40 through the supply channel 30 is ejected by the head unit 40. Operations of the head unit 40 are controlled by the control unit 90. The control unit 90 is configured as a computer including a CPU and a memory; the operations of the head unit 40 are controlled by the CPU executing a program stored in the memory. The program may be recorded on a permanent tangible recording medium.

Figure 2:
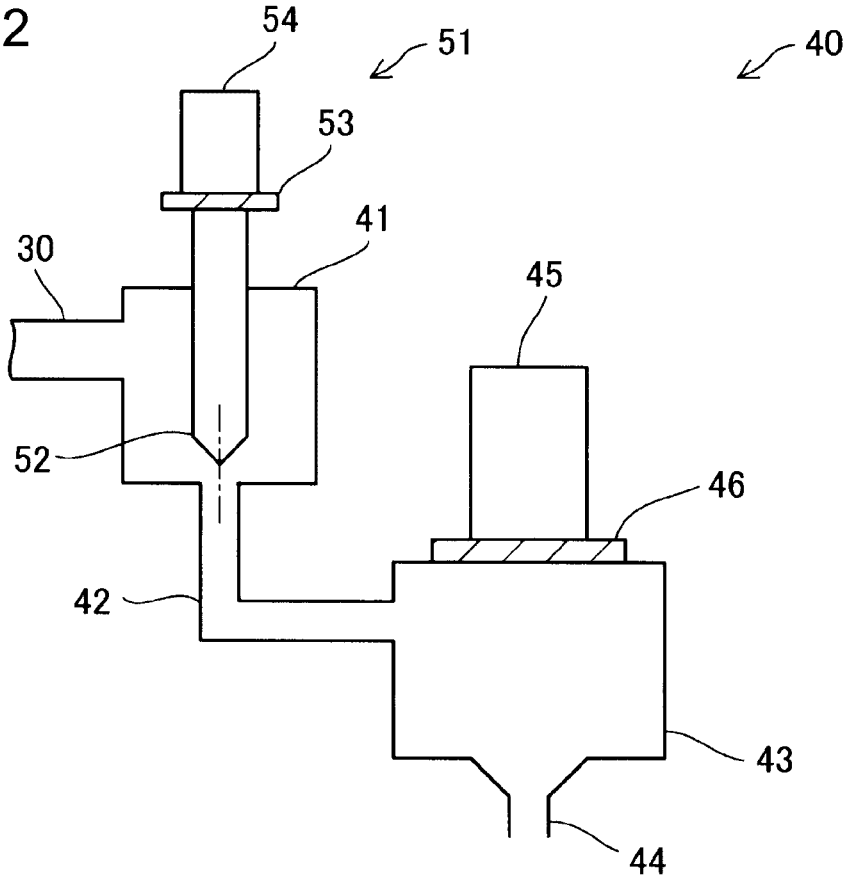
FIG. 2 is a first descriptive diagram illustrating a general structure of a head unit.

FIG. 2 is a first descriptive diagram illustrating a general structure of the head unit 40. The head unit 40 includes a common supply liquid chamber 41, an inflow channel 42, a pressure chamber 43, a nozzle 44, a pressure generation element 45, a vibration plate 46, and a first channel resistance changing section 51.

The common supply liquid chamber 41 is connected to the supply channel 30. The pressure generated by the pressurizing unit 20 causes the liquid having entered from the supply channel 30 into the common supply liquid chamber 41 to flow into the pressure chamber 43 through the inflow channel 42 connected to the common supply liquid chamber 41.

The first channel resistance changing section 51 is provided in the common supply liquid chamber 41. The first channel resistance changing section 51 is configured of a first rod 52, a first base portion 53, and a first actuator 54. The first rod 52 is attached to the first base portion 53, and the first actuator 54 is disposed on the first base portion 53. By the first actuator 54 driving the first base portion 53 in an up-down direction in FIG. 2, a leading end of the first rod 52 closes the inflow channel 42, thereby changing channel resistance of the inflow channel 42. The control unit 90 controls the driving of the first actuator 54. The control unit 90 repeats operation of switching between a first state in which the control unit 90 controls the first channel resistance changing section 51 to increase the channel resistance of the inflow channel 42 and a second state in which the control unit 90 controls the first channel resistance changing section 51 to make the channel resistance of the inflow channel 42 smaller than the channel resistance thereof in the first state. In the first state, the channel resistance is increased to the extent that the liquid does not flow into the inflow channel 42 from the common supply liquid chamber 41. In the second state, the channel resistance is decreased to the extent that the liquid flows into the inflow channel 42 from the common supply liquid chamber 41.

The pressure chamber 43 is connected with the inflow channel 42, and the liquid having flowed through the inflow channel 42 enters into the pressure chamber 43. The pressure chamber 43 communicates with the nozzle 44. A pressure generation element 45 is provided on one wall face of the pressure chamber 43 with a vibration plate 46 interposed therebetween. In the present embodiment, the pressure generation element 45 is a piezoelectric element, which is controlled by the control unit 90 and expands or contracts in accordance with a voltage applied thereto. With the expansion or contraction of the pressure generation element 45, the vibration plate 46 is pushed or pulled, whereby the volume of the interior of the pressure chamber 43 is changed. With the change in volume of the interior of the pressure chamber 43, the pressure of the liquid inside the pressure chamber 43 changes so that the liquid is ejected through the nozzle 44 when the pressure of the liquid inside the pressure chamber 43 exceeds a meniscus withstanding pressure in the nozzle 44.

To be more specific with respect to the control of the pressure generation element 45 by the control unit 90, the control unit 90 is so configured as to be capable of supplying a signal of expansion (see FIG. 5) to the pressure generation element 45 for making the volume of the pressure chamber 43 be in an expanded state and a signal of reduction (see FIG. 5) to the pressure generation element 45 for making the volume of the pressure chamber 43 be in a reduced state. The control unit 90 expands the volume of the pressure chamber 43 by supplying the signal of expansion to the pressure generation element 45 or by stopping the supply of the signal of reduction to the pressure generation element 45. The control unit 90 reduces the volume of the pressure chamber 43 by supplying the signal of reduction to the pressure generation element 45 or by stopping the supply of the signal of expansion to the pressure generation element 45.

Figure 3:
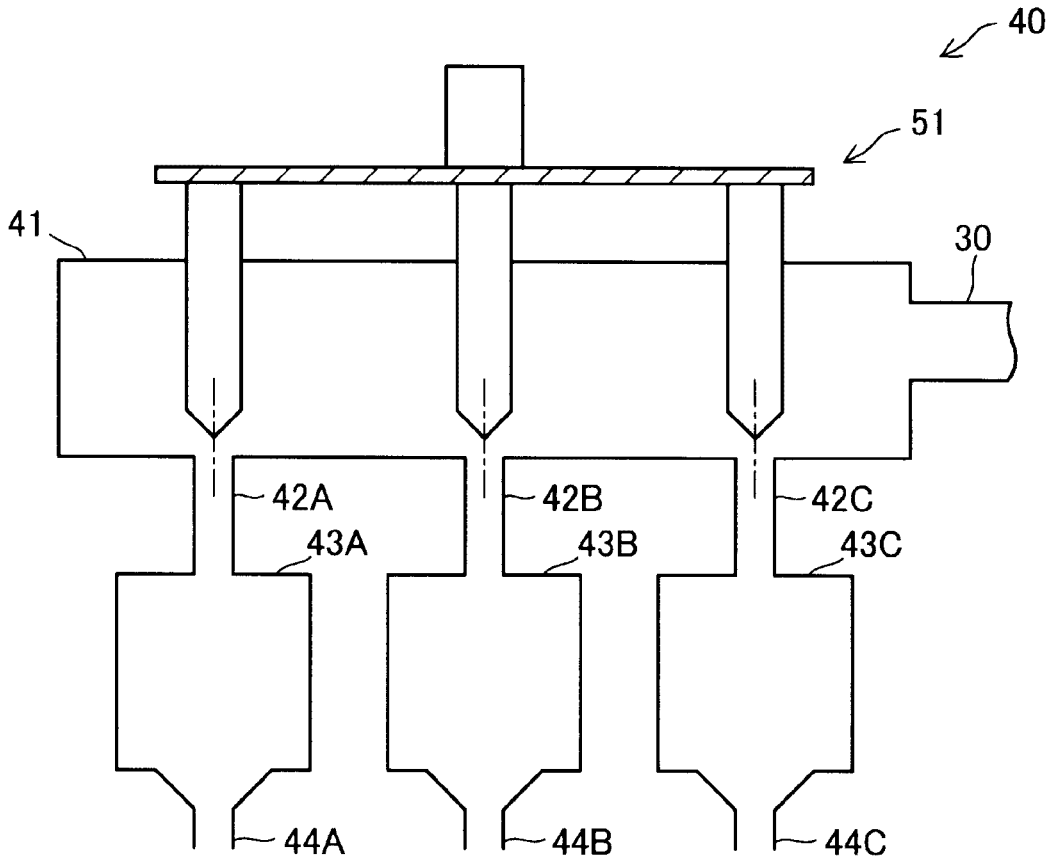
FIG. 3 is a second descriptive diagram illustrating a general structure of a head unit.

FIG. 3 is a second descriptive diagram illustrating a general structure of the head unit 40. The head unit 40 includes three nozzles 44A, 44B and 44C, three pressure chambers 43A, 43B and 43C communicating with the nozzles 44A, 44B and 44C respectively, and three inflow channels 42A, 42B and 42C connected to the pressure chambers 43A, 43B and 43C respectively. Each of the pressure chambers 43A, 43B, and 43C is provided with the pressure generation element 45 and the vibration plate 46. The first channel resistance changing section 51 collectively changes channel resistance of each of the inflow channels 42A, 42B, and 42C. Although, in the present embodiment, the number of nozzles 44 is three, any number of nozzles 44 can be taken as long as the number is larger than one. Further, the head unit 40 may include two or more first channel resistance changing sections 51 inside the common supply liquid chamber 41. For example, in a case where the head unit 40 includes two first channel resistance changing sections 51, four pressure chambers 43, and four inflow channels 42, one first channel resistance changing section 51 collectively changes the channel resistance of two inflow channels 42 connected to two pressure chambers 43, and the other first channel resistance changing section 51 collectively changes the channel resistance of two inflow channels 42 connected to the remaining two pressure chambers 43.

Figure 4:
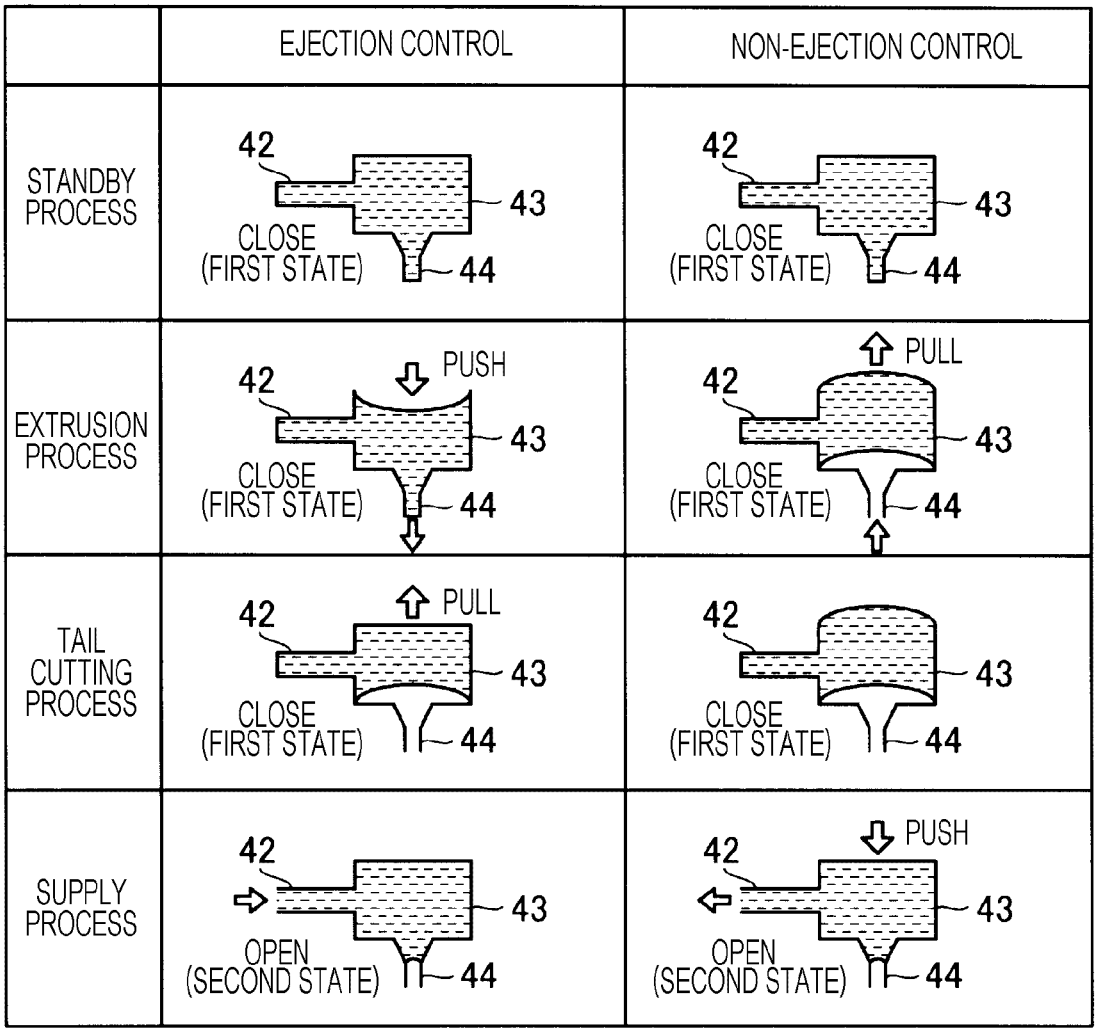
FIG. 4 is a process diagram illustrating contents of ejection control and non-ejection control in the first embodiment.

FIG. 4 is a process diagram illustrating contents of ejection control and non-ejection control carried out by the control unit 90. In this specification, "ejection control" refers to the control which the control unit 90 carries out by controlling an "pressure generation element", which is the pressure generation element 45 corresponding to an ejection nozzle that ejects the liquid. Further, "non-ejection control" refers to the control which the control unit 90 carries out by controlling a "non-pressure generation element", which is the pressure generation element 45 corresponding to a non-ejection nozzle that does not eject the liquid. In addition, in this specification, "ejection nozzle" refers to the nozzle 44 that ejects the liquid, while "non-ejection nozzle" refers to the nozzle 44 that does not eject the liquid. The control unit 90 controls each nozzle 44 to make it serve as an ejection nozzle or as a non-ejection nozzle for each one cycle in accordance with the printing pattern. "One cycle" refers to a series of processes from a standby process through a supply process.

The ejection control and the non-ejection control of the present embodiment each include the standby process, an extrusion process, a tail cutting process, and the supply process. In FIG. 4, states of the pressure chamber 43 in each of the processes in the ejection control and the non-ejection control are illustrated.

In the standby process, the control unit 90 controls the first channel resistance changing section 51 so that the channel resistance of the inflow channel 42 is made to be in a first state in which the channel resistance thereof is large. In the ejection control, the pressure chamber 43 is in an initial state. In the non-ejection control, the pressure chamber 43 is also in an initial state. In this specification, the state of the pressure chamber 43 in the standby process is referred to as the "initial state". The state of the pressure chamber 43 in which the volume thereof is expanded compared to the volume in the initial state is referred to as the "expanded state". The state of the pressure chamber 43 in which the volume thereof is reduced compared to the volume in the initial state is referred to as the "reduced state".

In the extrusion process, the channel resistance of the inflow channel 42 is made, by the control unit 90, to be in the first state in which the channel resistance thereof is large. In the ejection control, the control unit 90 controls the pressure generation element so that the volume of the pressure chamber 43 is reduced, thereby making the pressure chamber 43 in the reduced state. With this, the liquid is ejected through the ejection nozzle and a liquid column is formed. In the non-ejection control, the control unit 90 controls the non-pressure generation element so that the volume of the pressure chamber 43 is expanded, thereby making the pressure chamber 43 in the expanded state. With this, the air, substantially in the same amount of volume as the expanded amount of volume of the pressure chamber 43, is sucked through the non-ejection nozzle, so that a large meniscus is formed inside the pressure chamber 43. A timing at which the volume of the pressure chamber 43 is reduced by controlling the pressure generation element and a timing at which the volume of the pressure chamber 43 is expanded by controlling the non-pressure generation element may be the same timing, the timing of the pressure generation element side may be earlier, or the timing of the non-pressure generation element side may be earlier. The volume of the pressure chamber 43 corresponding to the non-ejection nozzle may be expanded in the tail cutting process to be explained later, which is carried out after the volume of the pressure chamber 43 corresponding to the ejection nozzle has been reduced. It may be unnecessary for the first channel resistance changing section 51 to completely close the inflow channel 42 in the processes other than the standby process, and it is sufficient for the channel resistance of the inflow channel 42 to be a channel resistance needed to eject the liquid through the ejection nozzle.

In the tail cutting process, the channel resistance of the inflow channel 42 is made, by the control unit 90, to be in the first state in which the channel resistance thereof is large. In the ejection control, the control unit 90 controls the pressure generation element so that the volume of the pressure chamber 43 is expanded and the pressure chamber 43 is made to return to the initial state. With this, a rear end of the liquid column formed in the extrusion process is sucked into the ejection nozzle so that the liquid column is torn off. In the non-ejection control, the control unit 90 controls the non-pressure generation element so that the pressure chamber 43 is maintained in the expanded state. Accordingly, a state in which a large meniscus is formed within the pressure chamber 43 is maintained.

In the supply process, the channel resistance of the inflow channel 42 is switched, by the control unit 90, to the second state in which the channel resistance thereof is smaller than that in the first state. In the ejection control, by controlling the pressure generation element, the pressure chamber 43 is maintained in the initial state. Further, since the channel resistance of the inflow channel 42 is switched to the second state, the liquid is supplied into the pressure chamber 43 from the inflow channel 42 by the pressure generated by the pressurizing unit 20. In the non-ejection control, the control unit 90 controls the non-pressure generation element so that the volume of the interior of the pressure chamber 43 is reduced and the pressure chamber 43 is made to return to the initial state. With this, the liquid inside the pressure chamber 43 in an amount equivalent to the amount of change in the volume of the pressure chamber 43 flows to the inflow channel 42. At this time, the control is performed in such a manner that the pressure inside the pressure chamber 43 corresponding to the non-ejection nozzle does not exceed the meniscus withstanding pressure in the nozzle 44. By controlling a speed at which the non-pressure generation element reduces the pressure chamber 43 in consideration of the balance among the pressure by the pressurizing unit 20, the channel resistance of the inflow channel 42, and the channel resistance of the nozzle 44, the liquid in an amount equivalent to a reduced amount of volume of the pressure chamber 43 flows to the inflow channel 42 and does not leak from the non-ejection nozzle. The timing at which the non-pressure generation element is controlled to reduce the volume of the interior of the pressure chamber 43 may be any timing as long as the stated timing is a timing at which the channel resistance of the inflow channel 42 is small.

Thereafter, at a timing at which an appropriate amount of liquid is supplied to the ejection nozzle, the process returns to the standby process again, and the ejection control and the non-ejection control are repeated. In the present embodiment, the extrusion process under the ejection control corresponds to "extrusion control" in the appended claims, and the extrusion process and the supply process under the non-ejection control correspond to "intake and exhaust control" in the appended claims. Here, "intake" in the term "intake and exhaust control" means that the nozzle 44 sucks the air, while "exhaust" means discharging the liquid to the inflow channel 42 or discharging the air through the nozzle 44.

Figure 5:
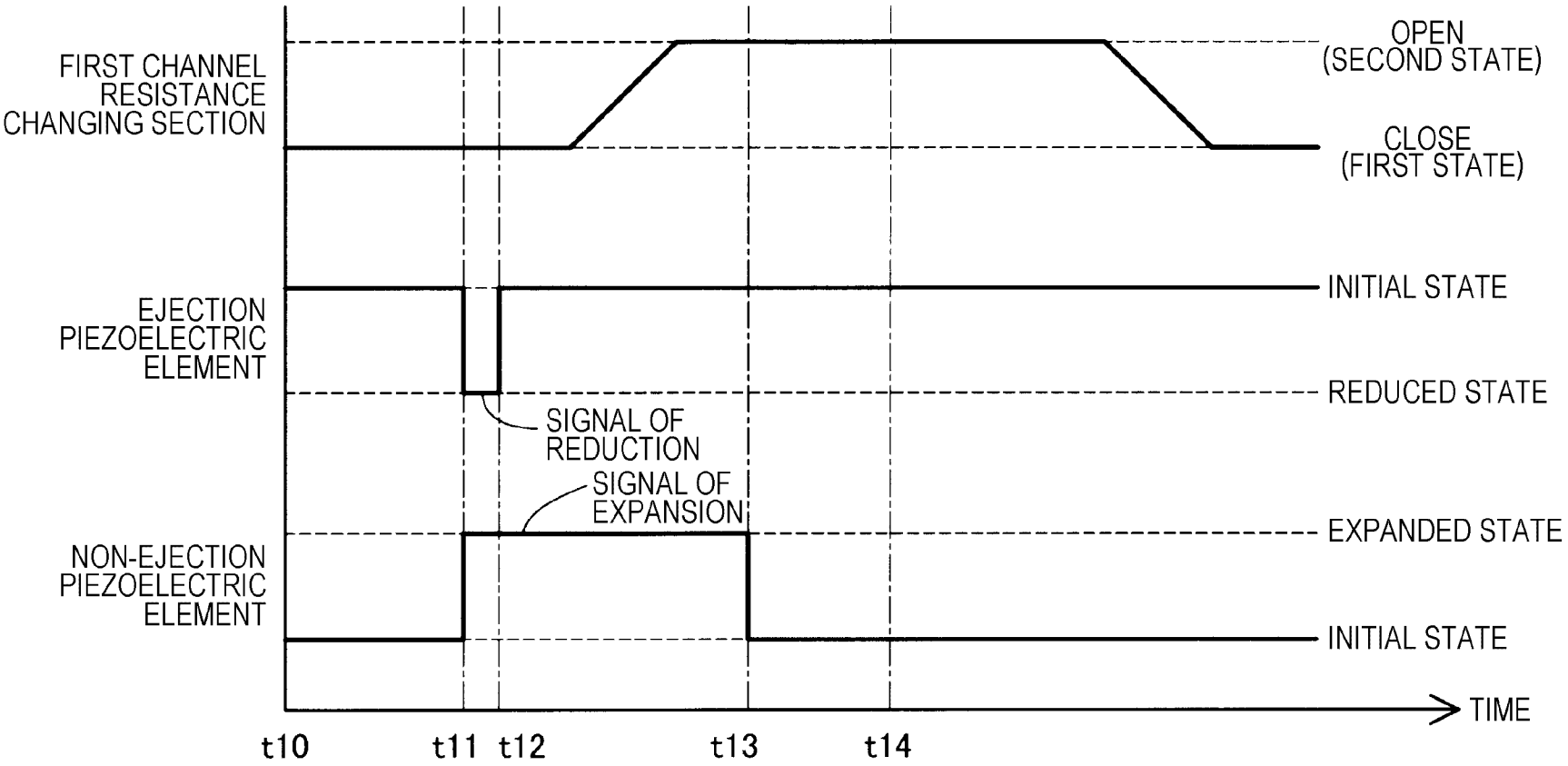
FIG. 5 is a time chart illustrating operations of pressure generation elements in the first embodiment.
Figure 6:
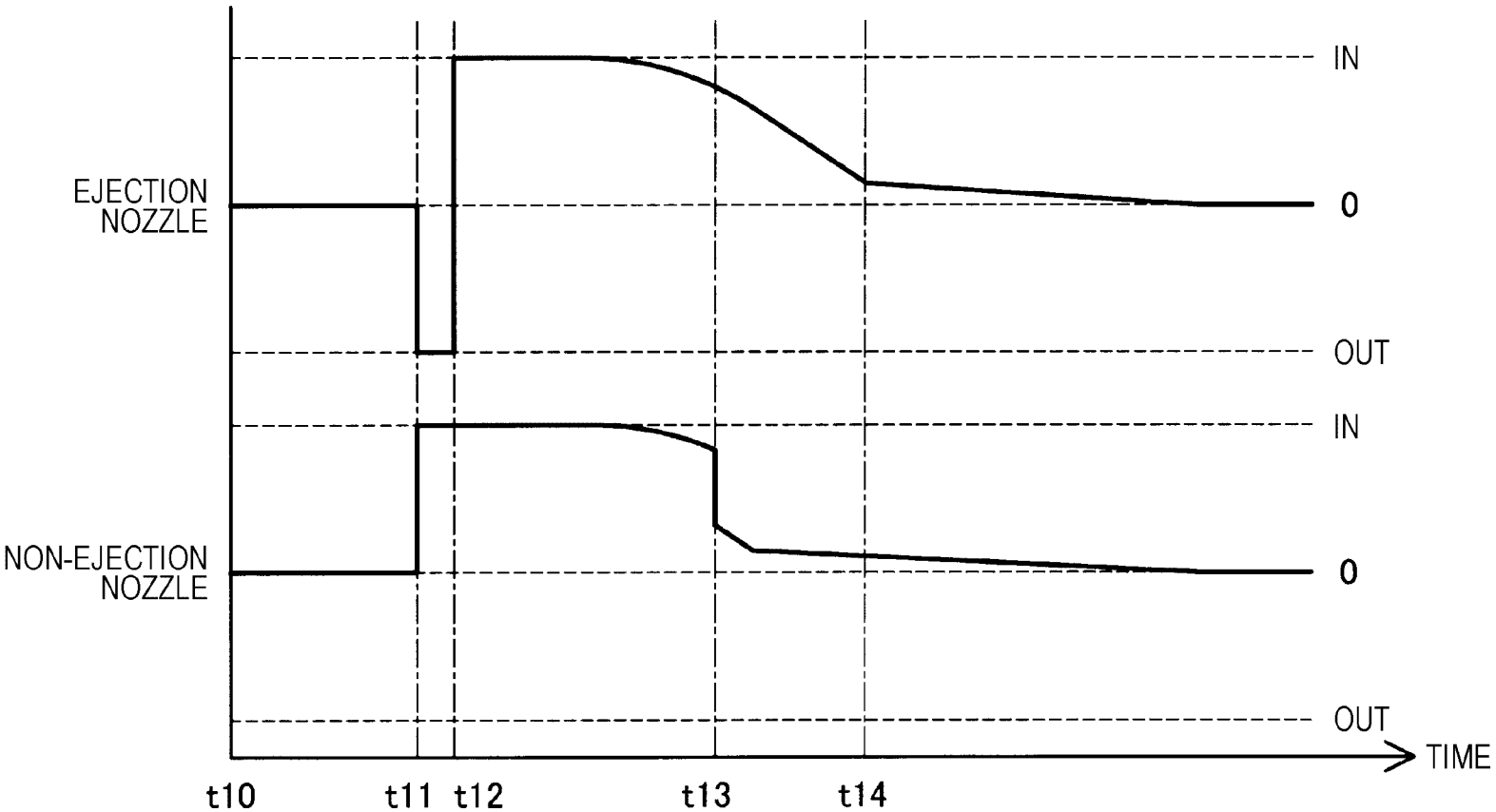
FIG. 6 is a time chart illustrating meniscus behavior in the first embodiment.

FIG. 5 is a time chart illustrating operations of the pressure generation element 45 in the ejection control and the non-ejection control. The horizontal axis represents a time for one cycle. The vertical axis represents a state of the first channel resistance changing section 51, a state of the pressure generation element, and a state of the non-pressure generation element. FIG. 6 is a descriptive diagram illustrating meniscus behavior in the ejection nozzle and the non-ejection nozzle. The horizontal axis represents a time for one cycle. Reference numerals on the horizontal axis correspond to those in FIG. 5. The vertical axis represents, while taking a position of a liquid level inside the nozzle 44 in the standby process as a neutral position (a position indicated with "0" in FIG. 6), on which side relative to the neutral position, that is, an outer side or an inner side (the pressure chamber 43 side) relative to the neutral position, the liquid level is formed. A state in which the liquid level is formed at a position on the inner side relative to the neutral position includes a state in which the liquid level is formed inside the nozzle 44 and a state in which the liquid level is formed inside the pressure chamber 43.

Operations of the pressure generation element and the meniscus behavior in the ejection nozzle will be described with reference to FIGS. 4 to 6. In FIG. 5, a period from a timing t10 to a timing t11 corresponds to the standby process in FIG. 4. A period from the timing t11 to a timing t12 corresponds to the extrusion process in FIG. 4, where the control unit 90 supplies a signal of reduction so that the pressure generation element causes the pressure chamber 43 to be in the reduced state. The timing t12 corresponds to the tail cutting process in FIG. 4, where the control unit 90 stops the supply of the signal of reduction so that the pressure generation element causes the pressure chamber 43 to return to the initial state from the reduced state. Next, in FIG. 6, in the period from the timing t10 to the timing t11 corresponding to the standby process, the liquid level of the ejection nozzle is formed at the leading end of the ejection nozzle. In the period from the timing t11 to the timing t12 corresponding to the extrusion process, since the liquid is ejected through the ejection nozzle, the liquid level is formed at the outer side of the ejection nozzle. At the timing t12 corresponding to the tail cutting process, the air is sucked in through the ejection nozzle and the liquid level is formed at the inner side (the pressure chamber 43 side) of the ejection nozzle. Thereafter, at a timing t13 corresponding to a start timing of the supply process, since the supply of the liquid to the ejection nozzle has been started, the position of the liquid level gradually approaches the leading end of the ejection nozzle in the initial state. When the liquid level arrives at the interior of the nozzle 44 (timing t14), the movement speed of the liquid level position becomes slower due to the channel resistance of the nozzle 44.

Operations of the non-pressure generation element and the meniscus behavior in the non-ejection nozzle will be described with reference to FIGS. 4 to 6. In FIG. 5, the period from the timing t10 to the timing t11 corresponds to the standby process in FIG. 4. The period from the timing t11 to the timing t12 corresponds to the extrusion process in FIG. 4, where the control unit 90 supplies a signal of expansion so that the non-pressure generation element causes the pressure chamber 43 to be in the expanded state. The timing t13 corresponds to the start timing of the supply process in FIG. 4, where the control unit 90 stops the supply of the signal of expansion so that the non-pressure generation element causes the pressure chamber 43 to return to the initial state from the expanded state. Next, in FIG. 6, in the period from the timing t10 to the timing t11 corresponding to the standby process, the liquid level of the non-ejection nozzle is formed at the leading end of the non-ejection nozzle. In the period from the timing t11 to the timing t12 corresponding to the extrusion process, since the air is sucked into the non-ejection nozzle, the liquid level is formed at the inner side (the pressure chamber 43 side) of the non-ejection nozzle. At the timing t13 corresponding to the start timing of the supply process, since the pressure chamber 43 is made to return to the initial state from the expanded state and the meniscus in the non-ejection nozzle becomes small, the liquid level rapidly approaches a leading end of the non-ejection nozzle. Thereafter, the liquid is supplied to the non-ejection nozzle, so that the position of the liquid level gradually approaches the leading end of the non-ejection nozzle in the initial state.

According to the liquid ejecting apparatus 5 of the present embodiment as described above, the control unit 90 reduces the volume of the pressure chamber 43 corresponding to the ejection nozzle in the first state in which the channel resistance of the inflow channel 42 is large, thereby ejecting the liquid through the ejection nozzle. Meanwhile, by the control unit 90 causing the volume of the pressure chamber 43 corresponding to the non-ejection nozzle to expand, the air is sucked in through the non-ejection nozzle and a meniscus is formed inside the pressure chamber 43. In the second state in which the channel resistance of the inflow channel 42 is small, the liquid is supplied from the inflow channel 42 to the pressure chamber 43 corresponding to the ejection nozzle. Meanwhile, by the control unit 90 causing the volume of the pressure chamber 43 corresponding to the non-ejection nozzle to reduce, the liquid inside the pressure chamber 43 flows to the inflow channel 42. Accordingly, by the first channel resistance changing section 51 collectively decreasing the channel resistance of a plurality of inflow channels 42, the leakage of the liquid from the non-ejection nozzle can be suppressed even when the pressurized liquid is supplied to both the pressure chamber 43 corresponding to the ejection nozzle and the pressure chamber 43 corresponding to the non-ejection nozzle.

In the present embodiment, since the first channel resistance changing section 51 can be shared, the head unit 40 can be miniaturized in comparison with a case in which the first channel resistance changing section 51 is separately provided for each of the inflow channels 42.

In the present embodiment, since the liquid is pressurized and supplied to the pressure chamber 43, the liquid with high viscosity can be ejected at a high frequency.

Further, in the present embodiment, since the control unit 90 can reduce the volume of the pressure chamber 43 corresponding to the ejection nozzle and can expand the volume of the pressure chamber 43 corresponding to the non-ejection nozzle at different timings, the leakage of the liquid from the non-ejection nozzle can be suppressed without strictly controlling the timings at which the volumes of the individual pressure chambers 43 are changed.

Furthermore, in the present embodiment, the control unit 90 controls the supply of the signal of expansion and the supply of the signal of reduction to the pressure generation element 45 so as to expand or contract the pressure generation element 45, thereby making it possible to change the volume of the pressure chamber 43.

B. Second Embodiment

Figure 7:
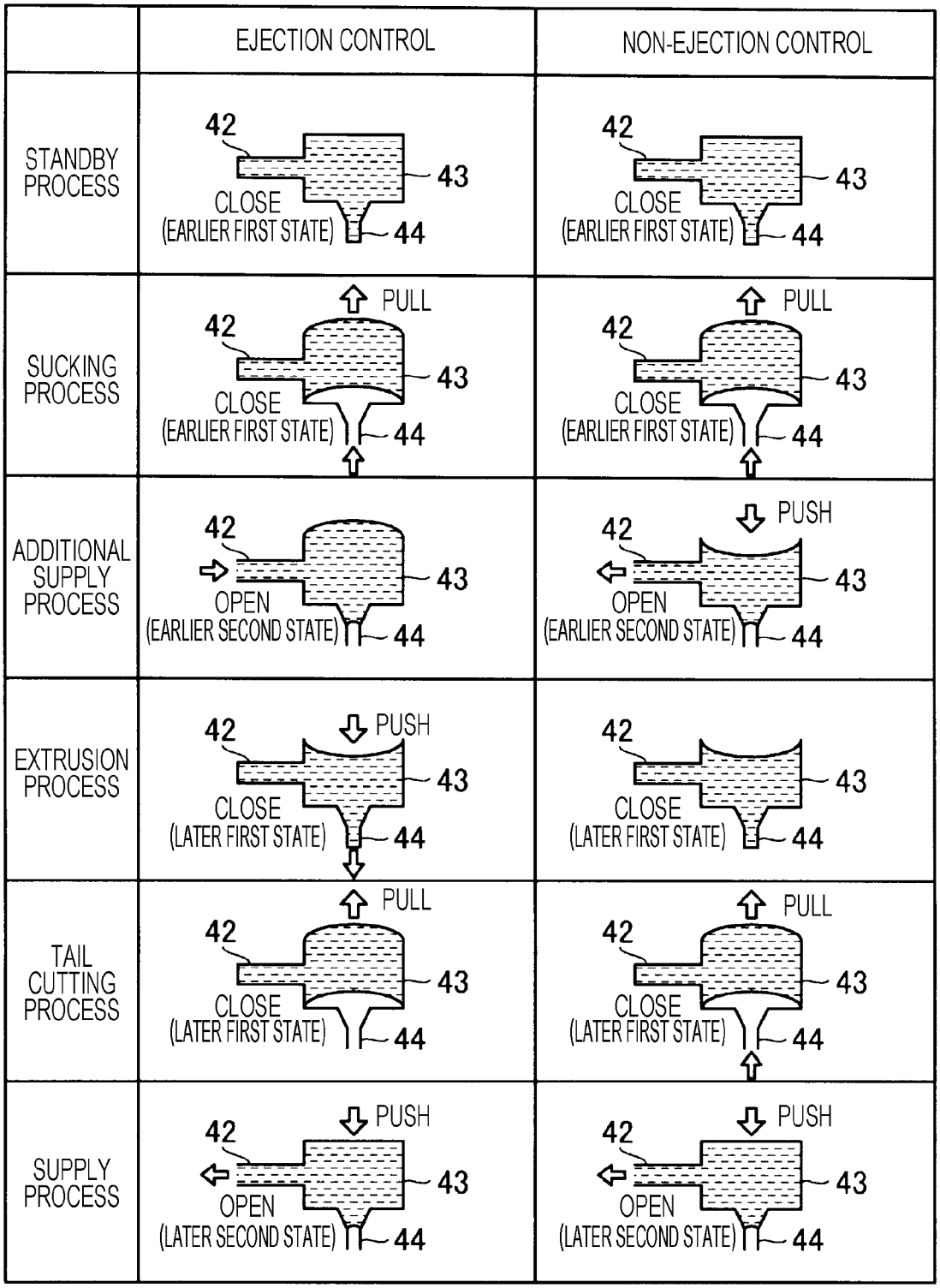
FIG. 7 is a process diagram illustrating contents of ejection control and non-ejection control in a second embodiment.

FIG. 7 is a process diagram illustrating contents of ejection control and non-ejection control in a second embodiment. The structure of the liquid ejecting apparatus 5 in the second embodiment is the same as that in the first embodiment (FIGS. 1 to 3). The contents of the ejection control and the non-ejection control in the second embodiment differ from those in the first embodiment (FIG. 4). To be specific, the ejection control and the non-ejection control of the first embodiment include the standby process, the extrusion process, the tail cutting process, and the supply process. Meanwhile, the ejection control and the non-ejection control of the present embodiment include a sucking process and an additional supply process between a standby process and an extrusion process. In the present embodiment, the control unit 90 switches twice from the first state to the second state during a period in which the ejection control and the non-ejection control are carried out, that is, once between the sucking process and the additional supply process and once between a tail cutting process and a supply process. The first state at the first time is called an "earlier first state", and the second state at the first time is called an "earlier second state"; the first state at the second time is called a "later first state", and the second state at the second time is called a "later second state".

Since the standby process in this embodiment is the same as that in the first embodiment, a description thereof is omitted.

In the sucking process, the channel resistance of the inflow channel 42 is made, by the control unit 90, to be in the first state (earlier first state) in which the channel resistance thereof is large. The control unit 90, in the ejection control, controls the pressure generation element to expand the volume of the pressure chamber 43 and cause the pressure chamber 43 to be in the expanded state from the initial state. With this, the air, substantially in the same amount of volume as the expanded amount of volume of the pressure chamber 43, is sucked through the ejection nozzle so that a large meniscus is formed inside the pressure chamber 43. The control unit 90, in the non-ejection control, controls the non-pressure generation element to expand the volume of the pressure chamber 43 and causes the pressure chamber 43 to be in the expanded state from the initial state. With this, the air, substantially in the same amount of volume as the expanded amount of volume of the pressure chamber 43, is sucked through the non-ejection nozzle, so that a large meniscus is formed inside the pressure chamber 43.

In the additional supply process, the channel resistance of the inflow channel 42 is switched, by the control unit 90, to the second state (earlier second state) in which the channel resistance thereof is smaller than that in the first state. The control unit 90, in the ejection control, controls the pressure generation element so that the pressure chamber 43 is maintained in the expanded state. Further, since the channel resistance of the inflow channel 42 is switched to the second state, the liquid is further supplied into the pressure chamber 43 from the inflow channel 42 by the pressure generated by the pressurizing unit 20. The control unit 90, in the non-ejection control, controls the pressure generation element 45 to reduce the volume in the interior of the pressure chamber 43 and cause the pressure chamber 43 to be in the reduced state from the expanded state. At this time, as discussed in the first embodiment, the volume reduction is performed at a speed at which the liquid does not leak from the non-ejection nozzle. Thereafter, at a timing at which an appropriate amount of liquid is supplied to the pressure chamber 43 corresponding to the ejection nozzle, the channel resistance of the inflow channel 42 is switched to the first state again in which the channel resistance is large. The above-mentioned "appropriate amount" may refer to a state in which the nozzle 44 is filled with the liquid down to the leading end of the nozzle 44, or a state in which a meniscus is formed inside the nozzle 44. By the nozzle 44 not being filled with the liquid to the extent that the liquid fills the leading end of the nozzle 44, the amount of droplets ejected through the nozzle 44 can be controlled.

In the extrusion process, the channel resistance of the inflow channel 42 is switched by the control unit 90 to the first state again (later first state) in which the channel resistance is large. The control unit 90, in the ejection control, controls the pressure generation element to reduce the volume of the pressure chamber 43 and cause the pressure chamber 43 to be in the reduced state from the expanded state. With this, the liquid is ejected through the ejection nozzle and a liquid column is formed. At this time, since the pressure chamber 43 corresponding to the ejection nozzle is changed from the expanded state to the reduced state, a change in volume of the interior of the pressure chamber 43 can be made large in comparison with the first embodiment. The control unit 90, in the non-ejection control, controls the non-pressure generation element so that the pressure chamber 43 is maintained to be in the reduced state.

In the tail cutting process, the channel resistance of the inflow channel 42 is maintained, by the control unit 90, to be in the first state (later first state) in which the channel resistance is large. The control unit 90, in the ejection control, controls the pressure generation element to expand the volume of the pressure chamber 43 and cause the pressure chamber 43 to be in the expanded state from the reduced state. With this, a rear end of the liquid column formed in the extrusion process is sucked into the ejection nozzle so that the liquid column is torn off. The control unit 90, in the non-ejection control, controls the non-pressure generation element to expand the volume of the pressure chamber 43 and cause the pressure chamber 43 to be in the expanded state from the reduced state. With this, the air is sucked in through the non-ejection nozzle. The volume of the pressure chamber 43 corresponding to the non-ejection nozzle may be expanded in any of the extrusion process and the tail cutting process.

In the supply process, the channel resistance of the inflow channel 42 is switched, by the control unit 90, to the second state again (later second state) in which the channel resistance is small. The control unit 90, in the ejection control, controls the pressure generation element to reduce the volume of the interior of the pressure chamber 43 and cause the pressure chamber 43 to be in the initial state from the expanded state. With this, the liquid inside the pressure chamber 43 in an amount equivalent to the amount of change in the volume of the pressure chamber 43 flows to the inflow channel 42. At this time, the control is performed in such a manner that the pressure inside the pressure chamber 43 corresponding to the ejection nozzle does not exceed the meniscus withstanding pressure in the nozzle 44. Like in the ejection control, the control unit 90, in the non-ejection control, controls the non-pressure generation element to reduce the volume of the interior of the pressure chamber 43 and cause the pressure chamber 43 to return to the initial state from the expanded state. With this, the liquid inside the pressure chamber 43 in an amount equivalent to the amount of change in the volume of the pressure chamber 43 flows to the inflow channel 42. At this time, the control is performed in such a manner that the pressure inside the pressure chamber 43 corresponding to the non-ejection nozzle does not exceed the meniscus withstanding pressure in the nozzle 44. In the present embodiment, the extrusion process under the ejection control corresponds to "extrusion control" in the appended claims, and the sucking process, the additional supply process, the tail cutting process and the supply process under the non-ejection control correspond to "intake and exhaust control" in the appended claims.

Figure 8:
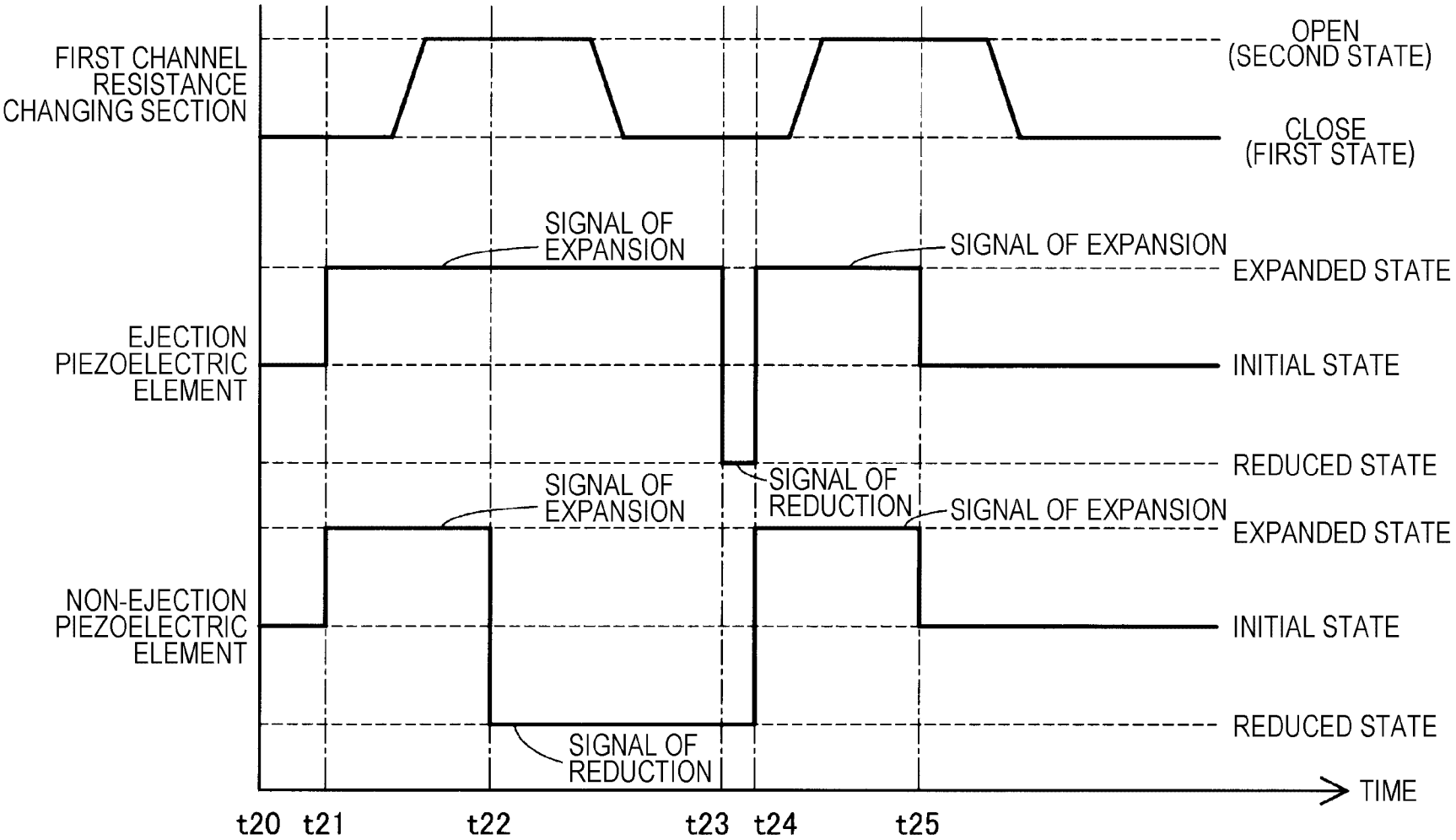
FIG. 8 is a time chart illustrating operations of pressure generation elements in the second embodiment.
Figure 9:
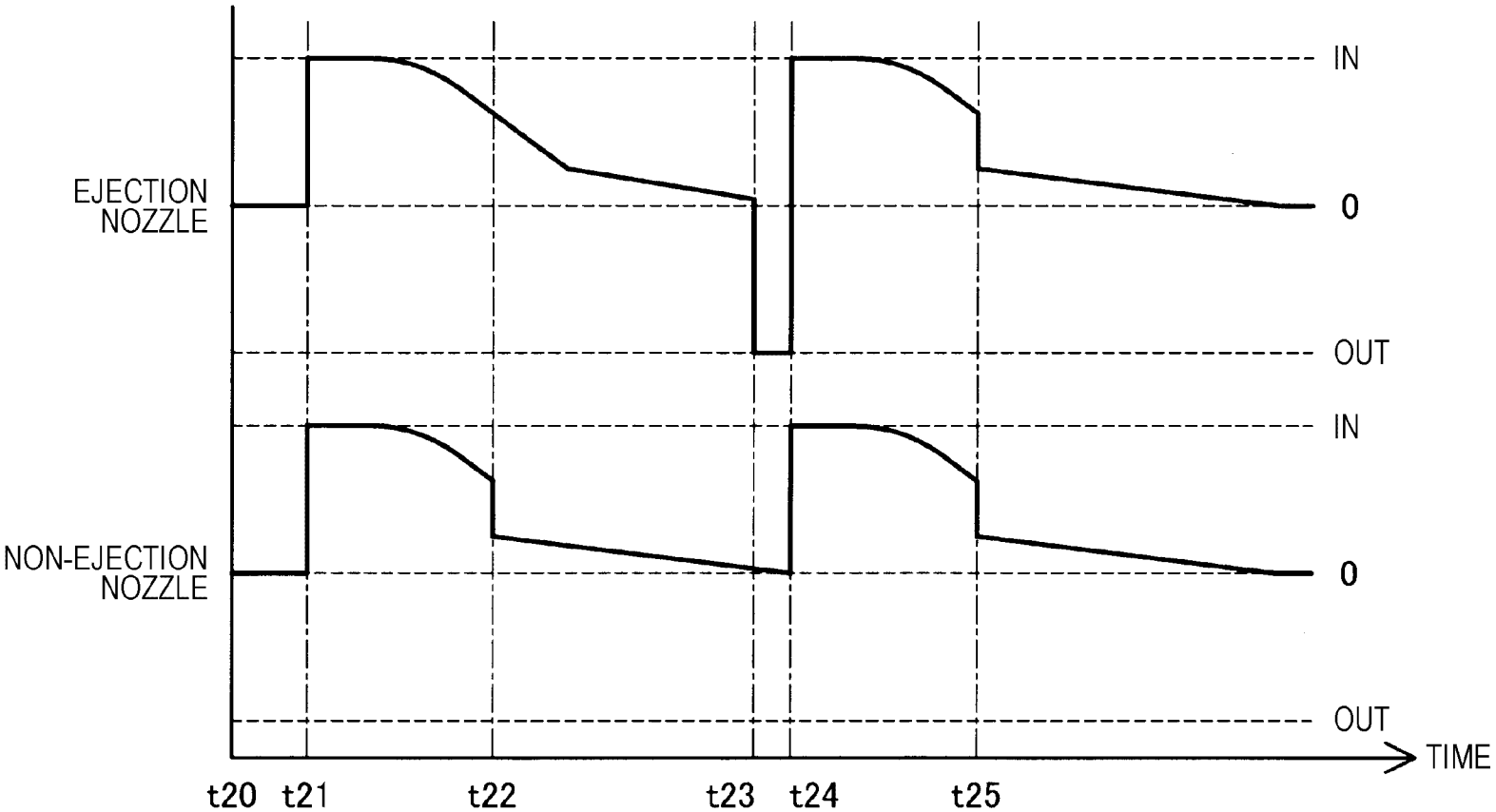
FIG. 9 is a time chart illustrating meniscus behavior in the second embodiment.

FIG. 8 is a time chart illustrating operations of the pressure generation element 45 in the ejection control and the non-ejection control of the present embodiment. FIG. 9 is a descriptive diagram illustrating meniscus behavior in the ejection nozzle and the non-ejection nozzle of the present embodiment.

Operations of the pressure generation element and the meniscus behavior in the ejection nozzle will be described with reference to FIGS. 7 to 9. In FIG. 8, a period from a timing t20 to a timing t21 corresponds to the standby process in FIG. 7. The timing t21 corresponds to a start timing of the sucking process in FIG. 7, where the control unit 90 supplies a signal of expansion so that the pressure generation element causes the pressure chamber 43 to be in the expanded state from the initial state. A period from a timing t23 to a timing t24 corresponds to the extrusion process in FIG. 7, where the control unit 90 stops the supply of the signal of expansion and supplies a signal of reduction so that the pressure generation element causes the pressure chamber 43 to be in the reduced state from the expanded state. The timing t24 corresponds to the tail cutting process in FIG. 7, where the control unit 90 stops the supply of the signal of reduction and supplies a signal of expansion so that the pressure generation element causes the pressure chamber 43 to be in the expanded state from the reduced state. A timing t25 corresponds to a start timing of the supply process in FIG. 7, where the control unit 90 stops the supply of the signal of expansion so that the pressure generation element causes the pressure chamber 43 to return to the initial state from the expanded state. Next, in FIG. 9, in the period from the timing t20 to the timing t21 corresponding to the standby process, the liquid level of the ejection nozzle is formed at the leading end of the ejection nozzle. Since the air is sucked into the ejection nozzle at the timing t21 corresponding to the start timing of the sucking process, the liquid level is formed at the inner side (the pressure chamber 43 side) of the ejection nozzle. At a timing t22 corresponding to a start timing of the additional supply process, since the liquid is further supplied into the pressure chamber 43, the position of the liquid level gradually approaches the leading end of the ejection nozzle. In the period from the timing t23 to the timing t24 corresponding to the extrusion process, since the liquid is ejected through the ejection nozzle, the liquid level is formed at the outer side of the ejection nozzle. At the timing t24 corresponding to the tail cutting process, the air is sucked in through the ejection nozzle and the liquid level is formed at the inner side (the pressure chamber 43 side) of the ejection nozzle. At the timing t25 corresponding to the start timing of the supply process, since the pressure chamber 43 is made to return to the initial state from the expanded state and the meniscus inside the pressure chamber 43 becomes small, the liquid level rapidly approaches the leading end of the non-ejection nozzle. Thereafter, since the liquid is supplied to the ejection nozzle, the position of the liquid level gradually approaches the leading end of the ejection nozzle.

Operations of the non-pressure generation element and the meniscus behavior in the non-ejection nozzle will be described with reference to FIGS. 7 to 9. In FIG. 8, the period from the timing t20 to the timing t21 corresponds to the standby process in FIG. 7. The timing t21 corresponds to the start timing of the sucking process in FIG. 7, where the control unit 90 supplies the signal of expansion so that the non-pressure generation element causes the pressure chamber 43 to be in the expanded state from the initial state. The timing t22 corresponds to a start timing of the additional supply process in FIG. 7, where the control unit 90 stops the supply of the signal of expansion and supplies the signal of reduction so that the non-pressure generation element causes the pressure chamber 43 to be in the reduced state from the expanded state. The timing t24 corresponds to the tail cutting process in FIG. 7, where the control unit 90 stops the supply of the signal of reduction and supplies the signal of expansion so that the non-pressure generation element causes the pressure chamber 43 to be in the expanded state from the reduced state. A timing t25 corresponds to a start timing of the supply process in FIG. 7, where the control unit 90 stops the supply of the signal of expansion so that the non-pressure generation element causes the pressure chamber 43 to return to the initial state from the expanded state. Next, in FIG. 9, in the period from the timing t20 to the timing t21 corresponding to the standby process, the liquid level of the non-ejection nozzle is formed at the leading end of the non-ejection nozzle. Since the air is sucked into the non-ejection nozzle at the timing t21 corresponding to the start timing of the sucking process, the liquid level is formed at the inner side (the pressure chamber 43 side) of the non-ejection nozzle. At the timing t22 corresponding to the start timing of the additional supply process, since the pressure chamber 43 is made to be in the reduced state from the expanded state and the meniscus inside the pressure chamber 43 becomes small, the liquid level rapidly approaches the leading end of the non-ejection nozzle. Thereafter, since the liquid is supplied to the non-ejection nozzle, the position of the liquid level gradually approaches the leading end of the non-ejection nozzle. At the timing t24 corresponding to the tail cutting process, since the air is sucked into the non-ejection nozzle again, the liquid level is formed at the inner side (the pressure chamber 43 side) of the non-ejection nozzle. At the timing t25 corresponding to the start timing of the supply process, since the non-pressure generation element is made to return to the initial state from the expanded state and the meniscus inside the pressure chamber 43 becomes small, the liquid level rapidly approaches the leading end of the non-ejection nozzle. Thereafter, since the liquid is supplied to the non-ejection nozzle again, the position of the liquid level gradually approaches the leading end of the non-ejection nozzle in the initial state.

In the above-discussed liquid ejecting apparatus 5 of the present embodiment, when the liquid is ejected through the ejection nozzle, the totaled amount of displacement of a displacement amount of contraction of the pressure generation element 45 and a displacement amount of expansion thereof can be practically used to change the volume of the pressure chamber 43. With this, since the pressure generation element 45 can shift the volume of the interior of the pressure chamber 43 from the expanded state to the reduced state, the change in volume of the interior of the pressure chamber 43 can be made large in comparison with a case of shifting the volume of the interior of the pressure chamber 43 from the initial state to the reduced state. This makes it possible to increase the amount of liquid ejected through the nozzle 44. In addition, by making the change in volume of the pressure chamber 43 large, a change in pressure inside the pressure chamber 43 can be made large. This makes it possible to improve the stability of ejection of the liquid with high viscosity.

C. Third Embodiment

Figure 10:
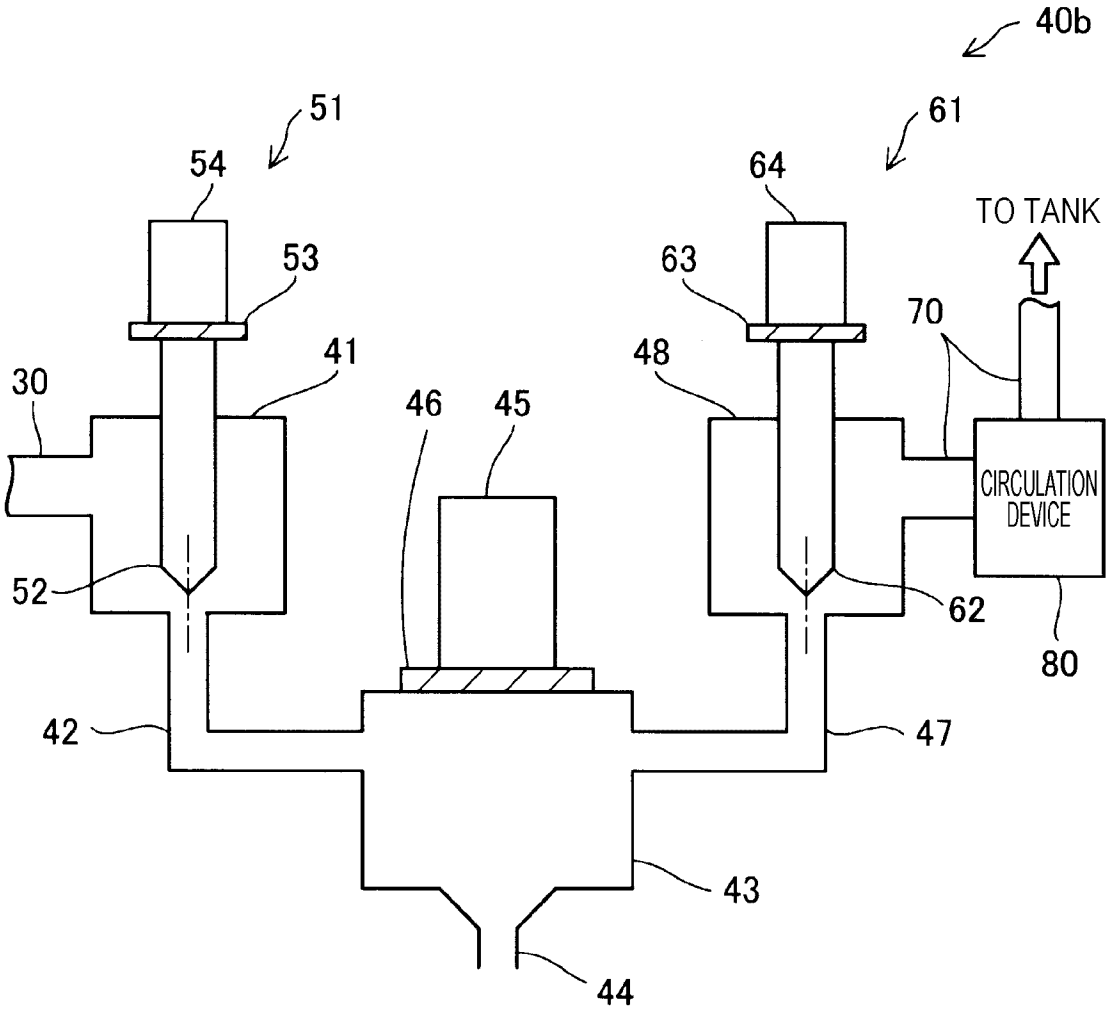
FIG. 10 is a third descriptive diagram illustrating a general structure of a head unit.
Figure 11:
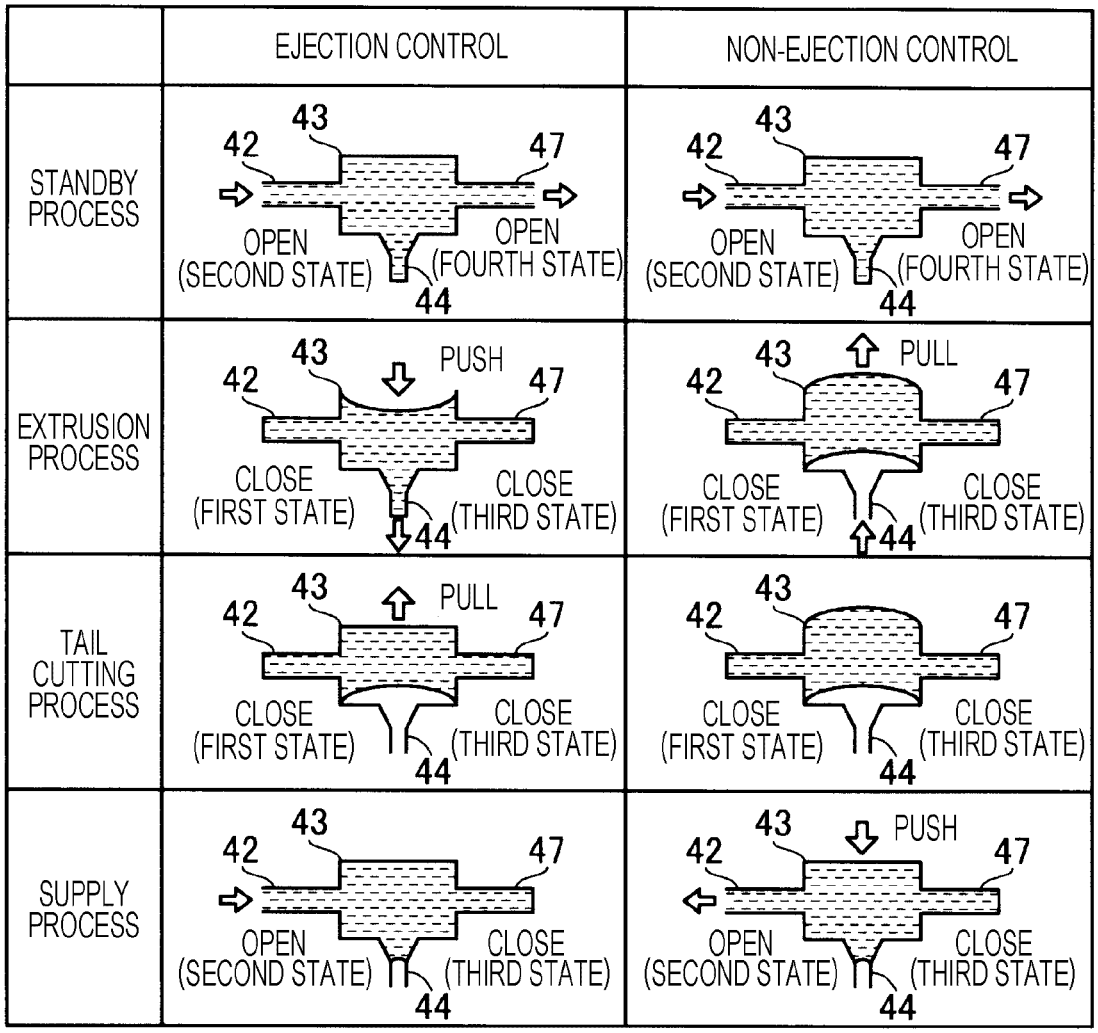
FIG. 11 is a process diagram illustrating contents of ejection control and non-ejection control in a third embodiment.

FIG. 10 is a third descriptive diagram illustrating a general structure of a head unit 40*b* according to a third embodiment. FIG. 11 is a process diagram illustrating contents of ejection control and non-ejection control in a third embodiment. The third embodiment differs from the first embodiment (FIG. 2) in that the head unit 40*b* includes an outflow channel 47, a common discharge liquid chamber 48, and a second channel resistance changing section 61. Further, the contents of the ejection control and the non-ejection control in the third embodiment are different from those in the first embodiment (FIG. 4).

The outflow channel 47 is connected to each of the pressure chambers 43, and causes a liquid to flow out from the pressure chamber 43. The outflow channel 47 is connected to the common discharge liquid chamber 48, and the common discharge liquid chamber 48 is connected to a discharge channel 70. The discharge channel 70 is provided with a circulation device 80. The circulation device 80 is constituted of a pump and the like. The liquid flowing in the outflow channel 47 flows from the common discharge liquid chamber 48 through the discharge channel 70, and is circulated to the tank 10 by the circulation device 80. Such a structure may be acceptable in which the liquid is discharged to the exterior of the liquid ejecting apparatus 5 without providing the circulation device 80.

The second channel resistance changing section 61 is disposed inside the common discharge liquid chamber 48 and collectively changes channel resistance of each of the outflow channels 47. The control unit 90 repeats operation of switching between a third state in which the control unit 90 controls the second channel resistance changing section 61 to increase the channel resistance of the outflow channel 47 in accordance with a timing at which the liquid is discharged to the plurality of outflow channels 47 from the pressure chamber 43 and a fourth state in which the control unit 90 controls the second channel resistance changing section 61 to make the channel resistance of the outflow channel 47 smaller than the channel resistance thereof in the third state. The second channel resistance changing section 61 is configured of a second rod 62, a second base portion 63 and a second actuator 64, and the above configuration is the same as that of the first channel resistance changing section 51. The second channel resistance changing section 61 is driven by the control unit 90 controlling the second actuator 64.

In the present embodiment, it may be unnecessary for the first channel resistance changing section 51 to completely close the inflow channel 42 in an extrusion process to be explained later, and it is sufficient for the channel resistance of the inflow channel 42 to be a channel resistance capable of ejecting the liquid through the ejection nozzle at that time. In addition, it may be unnecessary for the second channel resistance changing section 61 to completely close the outflow channel 47 in the extrusion process to be explained later, and it is sufficient for the channel resistance of the outflow channel 47 to be a channel resistance capable of ejecting the liquid through the ejection nozzle at that time.

The contents of the ejection control and the non-ejection control of the present embodiment will be described with reference to FIG. 11. The ejection control and the non-ejection control of the present embodiment include a standby process, the extrusion process, a tail cutting process and a supply process, and operations of the pressure generation element and the non-pressure generation element in these processes are the same as those in the first embodiment.

In the standby process, the channel resistance of the inflow channel 42 is made, by the control unit 90, to be in the second state in which the channel resistance is small. The channel resistance of the outflow channel 47 is made, by the control unit 90, to be in the fourth state in which the channel resistance is small. Accordingly, the liquid is supplied from the inflow channel 42 to the pressure chamber 43 corresponding to the ejection nozzle and the pressure chamber 43 corresponding to the non-ejection nozzle, and the liquid is discharged from the outflow channel 47. Contents of the ejection control and the non-ejection control in the standby process are the same as those in the first embodiment.

In the extrusion process, the channel resistance of the inflow channel 42 is switched by the control unit 90 to the first state in which the channel resistance is large. The channel resistance of the outflow channel 47 is switched by the control unit 90 to the third state in which the channel resistance is large. Contents of the ejection control and the non-ejection control in the extrusion process and effects brought by them are the same as those in the first embodiment.

In the tail cutting process, the channel resistance of the inflow channel 42 is made, by the control unit 90, to be in the first state in which the channel resistance thereof is large. The channel resistance of the outflow channel 47 is made, by the control unit 90, to be in the third state in which the channel resistance is large. Contents of the ejection control and the non-ejection control in the tail cutting process and effects brought by them are the same as those in the first embodiment.

In the supply process, the channel resistance of the inflow channel 42 is switched by the control unit 90 to the second state in which the channel resistance is small. The channel resistance of the outflow channel 47 is made, by the control unit 90, to be in the third state in which the channel resistance is large. Contents of the ejection control and the non-ejection control in the supply process and effects brought by them are the same as those in the first embodiment.

Thereafter, at a timing at which an appropriate amount of liquid is supplied to the ejection nozzle, the process returns to the standby process again, and the ejection control and the non-ejection control are repeated. In the present embodiment, a timing at which the volume of the pressure chamber 43 is expanded by controlling the non-pressure generation element and a timing at which the volume of the pressure chamber 43 is reduced by controlling the pressure generation element may not be the same timing. It is sufficient that the timing at which the non-pressure generation element is controlled to expand the volume of the interior of the pressure chamber 43 is a timing at which the channel resistance of the inflow channel 42 and the channel resistance of the outflow channel 47 are large. The timing at which the non-pressure generation element is controlled to reduce the volume of the pressure chamber 43 may not be in the supply process, but may be in the standby process of the next cycle. In this case, the liquid in the pressure chamber 43 can be flowed to both the inflow channel 42 and the outflow channel 47. In the present embodiment, the extrusion process under the ejection control corresponds to "extrusion control" in the appended claims, and the extrusion process and the supply process under the non-ejection control correspond to "intake and exhaust control" in the appended claims.

Figure 12:
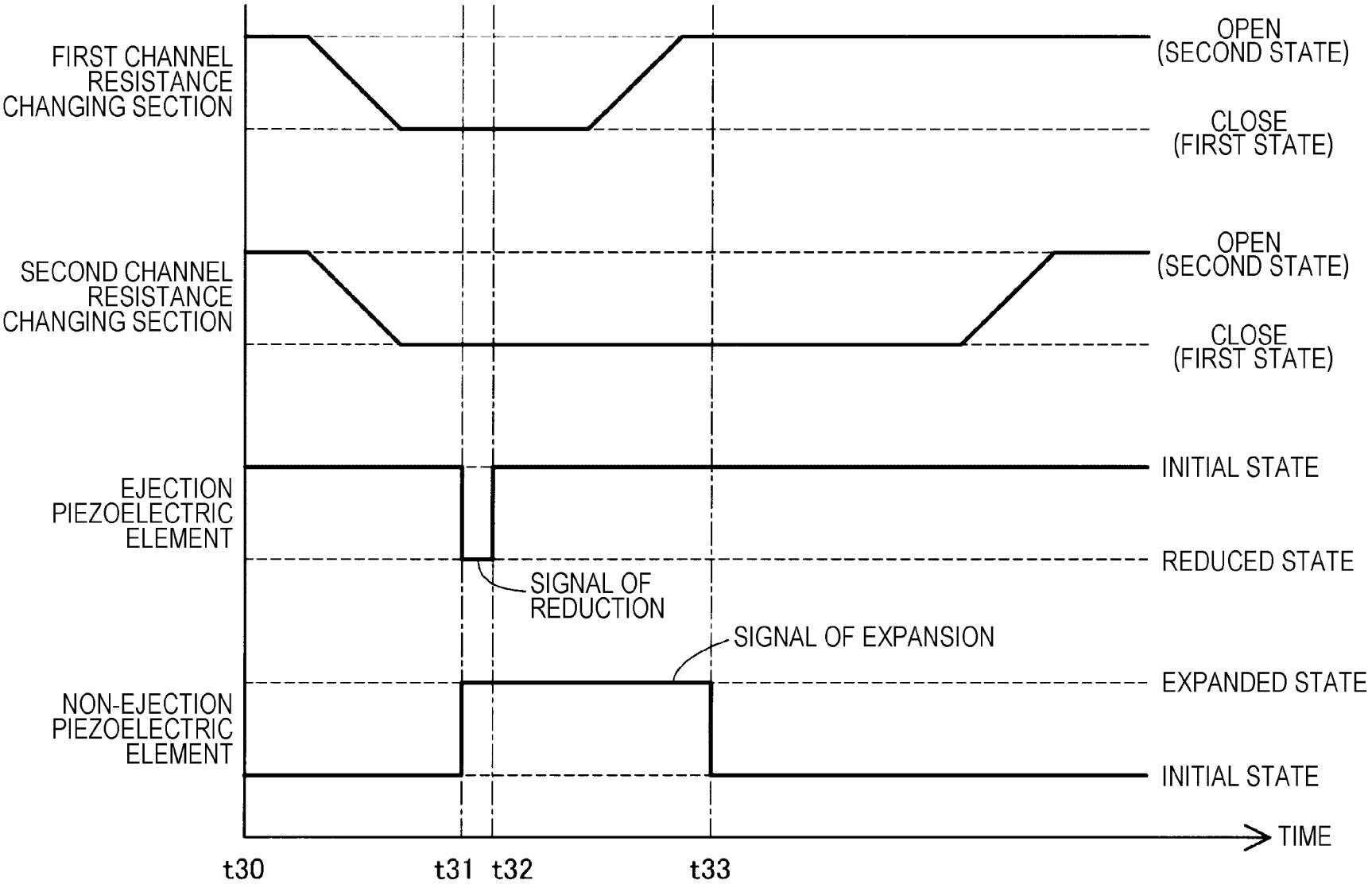
FIG. 12 is a time chart illustrating operations of pressure generation elements in the third embodiment.
Figure 13:
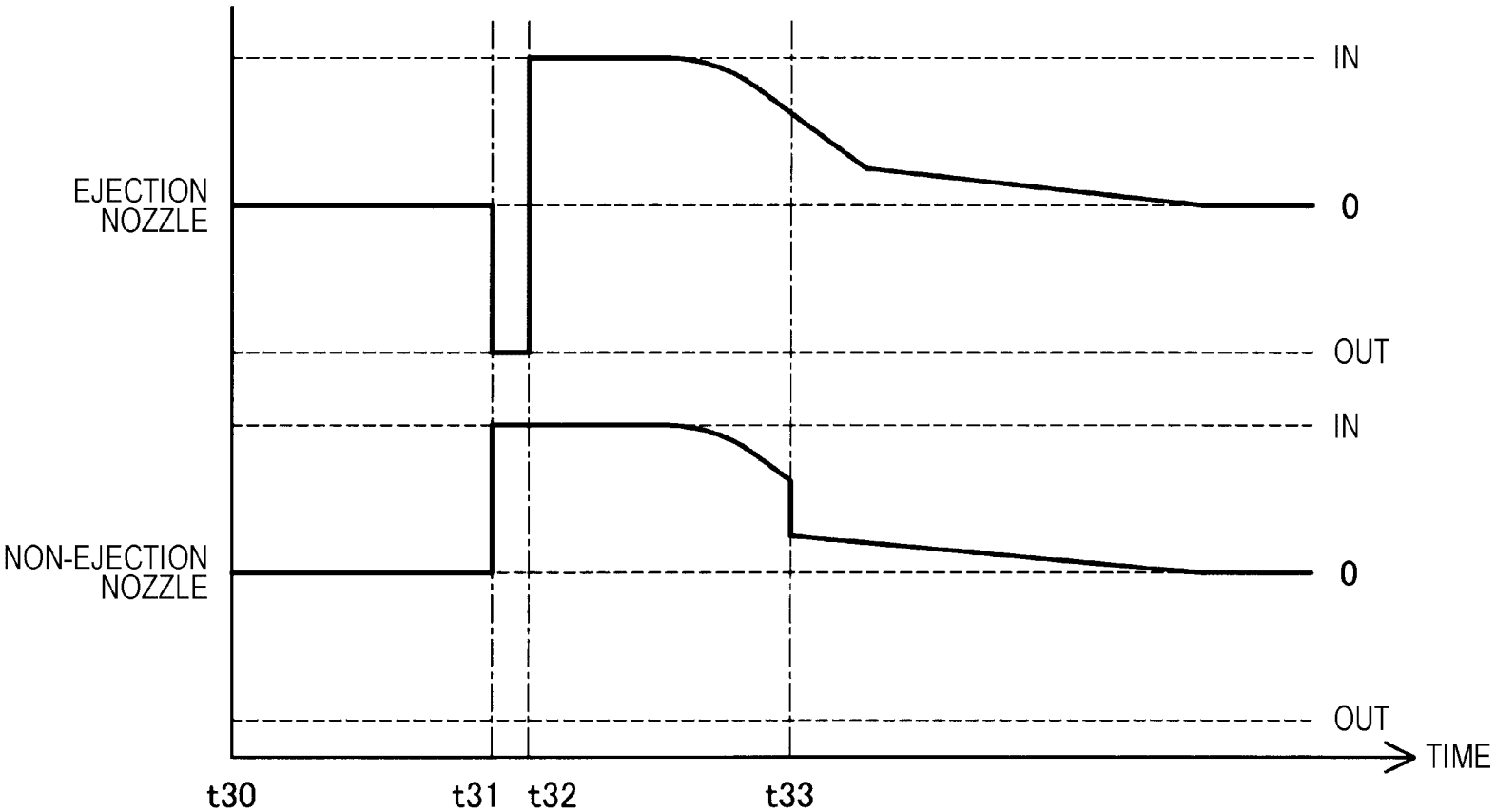
FIG. 13 is a time chart illustrating meniscus behavior in the third embodiment.

FIG. 12 is a time chart illustrating operations of the pressure generation element 45 in the ejection control and the non-ejection control of the present embodiment. FIG. 13 is a descriptive diagram illustrating meniscus behavior in the ejection nozzle and the non-ejection nozzle of the present embodiment.

Operations of the pressure generation element and the meniscus behavior in the ejection nozzle will be described with reference to FIGS. 11 to 13. In FIG. 12, a period from a timing t30 to a timing t31 corresponds to the standby process in FIG. 11. A period from the timing t31 to a timing t32 corresponds to the extrusion process in FIG. 11, where the control unit 90 supplies a signal of reduction so that the pressure generation element causes the pressure chamber 43 to be in the reduced state from the initial state. The timing t32 corresponds to the tail cutting process in FIG. 11, where the control unit 90 stops the supply of the signal of reduction so that the pressure generation element causes the pressure chamber 43 to return to the initial state from the reduced state. Next, in FIG. 13, in the period from the timing t30 to the timing t31 corresponding to the standby process, the liquid level of the ejection nozzle is formed at the leading end of the ejection nozzle. In the period from the timing t31 to the timing t32 corresponding to the extrusion process, since the liquid is ejected through the ejection nozzle, the liquid level is formed at the outer side of the ejection nozzle. At the timing t32 corresponding to the tail cutting process, since the tail cutting is performed, the air is sucked in through the ejection nozzle and the liquid level is formed at the inner side (the pressure chamber 43 side) of the ejection nozzle. Thereafter, at a timing t33 corresponding to a start timing of the supply process, since the liquid is supplied to the ejection nozzle, the position of the liquid level gradually approaches the leading end of the ejection nozzle.

Operations of the non-pressure generation element and the meniscus behavior in the non-ejection nozzle will be described with reference to FIGS. 11 to 13. In FIG. 12, the period from the timing t30 to the timing t31 corresponds to the standby process in FIG. 11. The period from the timing t31 to the timing t33 corresponds to the extrusion process and the tail cutting process in FIG. 11, where the control unit 90 supplies a signal of expansion so that the non-pressure generation element causes the pressure chamber 43 to be in the expanded state from the initial state. The timing t33 corresponds to the start timing of the supply process in FIG. 11, where the control unit 90 stops the supply of the signal of expansion so that the non-pressure generation element causes the pressure chamber 43 to return to the initial state from the expanded state. Next, in FIG. 13, in the period from the timing t30 to the timing t31 corresponding to the standby process, the liquid level of the non-ejection nozzle is formed at the leading end of the non-ejection nozzle. In the period from the timing t31 to the timing t33 corresponding to the extrusion process and the tail cutting process, since the air is sucked into the non-ejection nozzle, the liquid level is formed at the inner side (the pressure chamber 43 side) of the non-ejection nozzle. At the timing t33 corresponding to the start timing of the supply process, since the non-pressure generation element is made to return to the initial state from the expanded state and the meniscus in the non-ejection nozzle becomes small, the liquid level rapidly approaches the leading end of the non-ejection nozzle. Thereafter, since the liquid is supplied to the non-ejection nozzle, the position of the liquid level gradually approaches the leading end of the non-ejection nozzle.

In the above-described liquid ejecting apparatus 5 of the present embodiment, the liquid inside the pressure chamber 43 that was not used for ejection flows through the outflow channel 47 to be discharged to the exterior of the pressure chamber 43. Due to this, the agglomerates of composition in the liquid does not stay inside the pressure chamber 43, which makes it possible to suppress a failure of liquid ejection from the nozzle 44.

Further, in the present embodiment, the channel resistance of the outflow channel 47 is increased by the control unit 90 controlling the second channel resistance changing section 61 at the time of ejecting the liquid from the nozzle 44. Accordingly, a situation in which the pressure inside the pressure chamber 43 is released through the outflow channel 47 can be suppressed, so that a failure of liquid ejection from the nozzle 44 can be suppressed.

D. Fourth Embodiment

Figure 14:
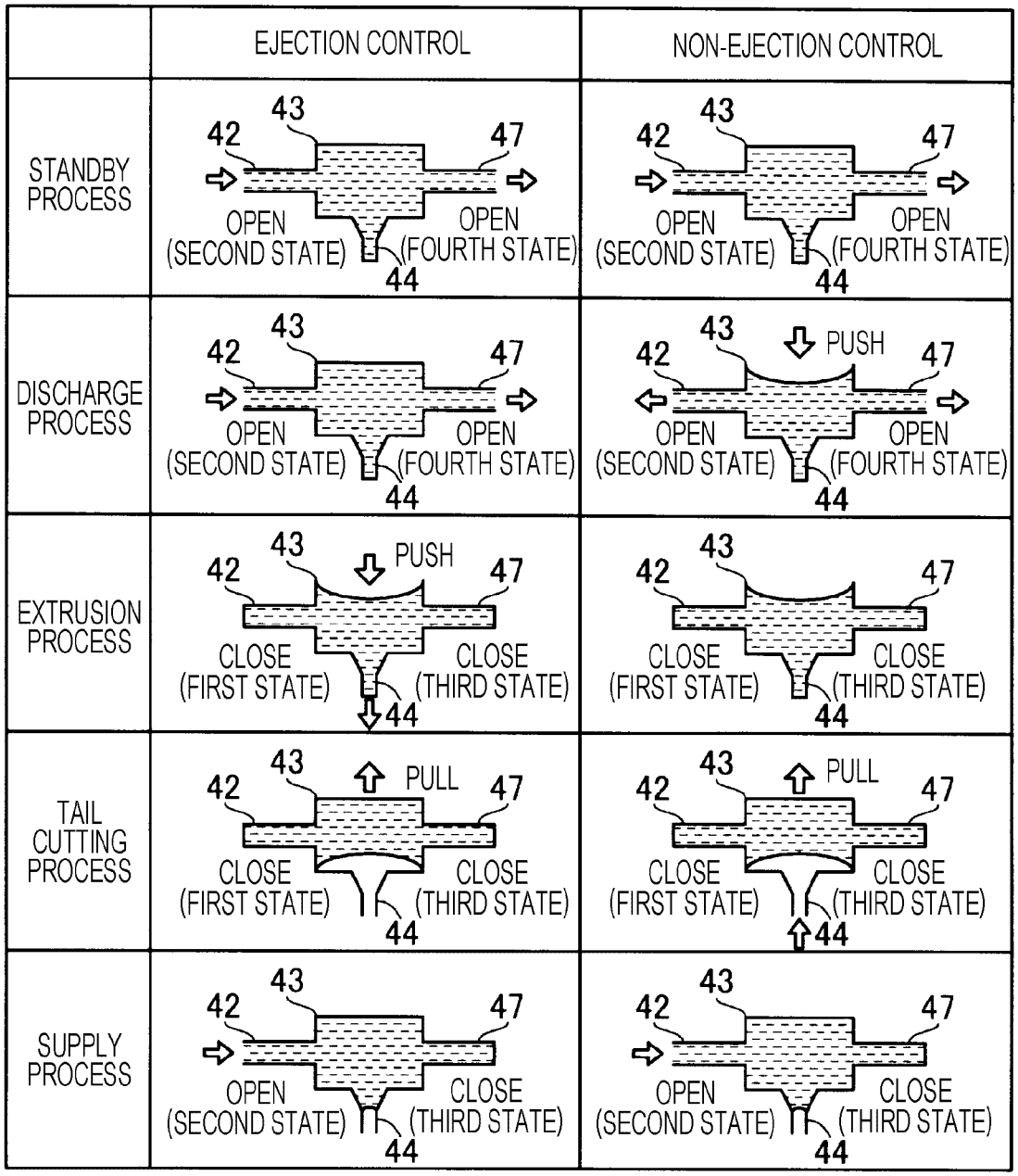
FIG. 14 is a process diagram illustrating contents of ejection control and non-ejection control in a fourth embodiment.

FIG. 14 is a process diagram illustrating contents of ejection control and non-ejection control in a fourth embodiment. The structure of the liquid ejecting apparatus 5 in the fourth embodiment is the same as that in the third embodiment (FIG. 10). The contents of the ejection control and the non-ejection control in the fourth embodiment differ from those in the third embodiment (FIG. 11). To be specific, the ejection control and the non-ejection control of the third embodiment include the standby process, the extrusion process, the tail cutting process, and the supply process. However, the ejection control and the non-ejection control of the present embodiment include a discharge process between a standby process and an extrusion process. In the third embodiment, the control unit 90, in the non-ejection control, controls the non-pressure generation element to expand the volume of the pressure chamber 43, and thereafter reduces the volume of the pressure chamber 43. However, in the present embodiment, the control unit 90, in the non-ejection control, controls the non-pressure generation element to reduce the volume of the pressure chamber 43, and thereafter expands the volume of the pressure chamber 43.

The contents of the ejection control and the non-ejection control of the present embodiment will be described with reference to FIG. 14.

Since the standby process in this embodiment is the same as that in the third embodiment, a description thereof is omitted.

In the discharge process, the channel resistance of the inflow channel 42 is made, by the control unit 90, to be in the second state in which the channel resistance is small. The channel resistance of the outflow channel 47 is made, by the control unit 90, to be in the fourth state in which the channel resistance is small. In the ejection control, the control unit 90 controls the pressure generation element to maintain the pressure chamber 43 in the initial state. With this, the pressure chamber 43 is maintained in the same state as the state of the standby process. The control unit 90, in the non-ejection control, controls the non-pressure generation element to reduce the volume of the interior of the pressure chamber 43 and cause the pressure chamber 43 to be in the reduced state from the initial state. With this, the liquid inside the pressure chamber 43, in an amount equivalent to the amount of change in volume of the pressure chamber 43, flows to the inflow channel 42 and the outflow channel 47. At this time, the control is performed in such a manner that the pressure inside the pressure chamber 43 corresponding to the non-ejection nozzle does not exceed the meniscus withstanding pressure in the nozzle 44.

In the extrusion process, the channel resistance of the inflow channel 42 is switched by the control unit 90 to the first state in which the channel resistance is large. The channel resistance of the outflow channel 47 is switched by the control unit 90 to the third state in which the channel resistance is large. The contents of the ejection control in the extrusion process and effects brought by them are the same as those in the third embodiment. In the non-ejection control, the control unit 90 controls the non-pressure generation element to maintain the pressure chamber 43 in the reduced state.

In a tail cutting process, the channel resistance of the inflow channel 42 is made, by the control unit 90, to be in the first state in which the channel resistance is large. The channel resistance of the outflow channel 47 is made, by the control unit 90, to be in the third state in which the channel resistance is large. The contents of the ejection control in the tail cutting process and effects brought by them are the same as those in the third embodiment. The control unit 90, in the non-ejection control, controls the non-pressure generation element to expand the volume of the pressure chamber 43 and cause the pressure chamber 43 to return to the initial state from the reduced state. With this, the air, substantially in the same amount of volume as the expanded amount of volume of the pressure chamber 43, is sucked through the non-ejection nozzle, so that a large meniscus is formed inside the pressure chamber 43.

In a supply process, the channel resistance of the inflow channel 42 is switched, by the control unit 90, to the second state in which the channel resistance is small. The channel resistance of the outflow channel 47 is made, by the control unit 90, to be in the third state in which the channel resistance is large. The contents of the ejection control in the supply process and effects brought by them are the same as those in the third embodiment. In the non-ejection control, the control unit 90 controls the non-pressure generation element to maintain the pressure chamber 43 in the initial state. Accordingly, the liquid is supplied to the interior of the pressure chamber 43 from the inflow channel 42. In the present embodiment, the extrusion process under the ejection control corresponds to "extrusion control" in the appended claims, and the discharge process and the tail cutting process under the non-ejection control correspond to "intake and exhaust control" in the appended claims.

Thereafter, at a timing at which an appropriate amount of liquid is supplied to the ejection nozzle and the non-ejection nozzle, the process returns to the standby process again, and the ejection control and the non-ejection control are repeated.

Figure 15:
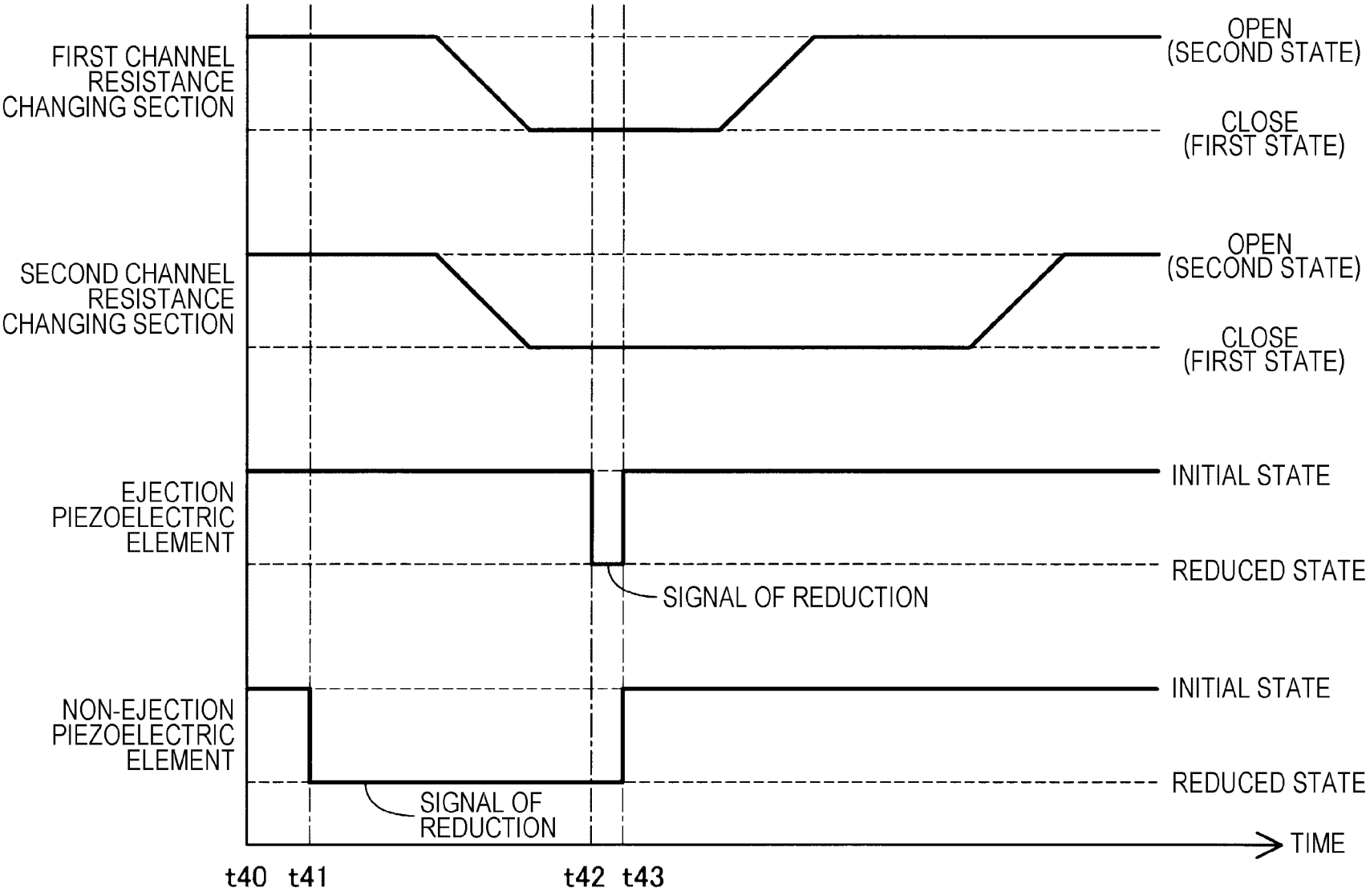
FIG. 15 is a time chart illustrating operations of pressure generation elements in the fourth embodiment.
Figure 16:
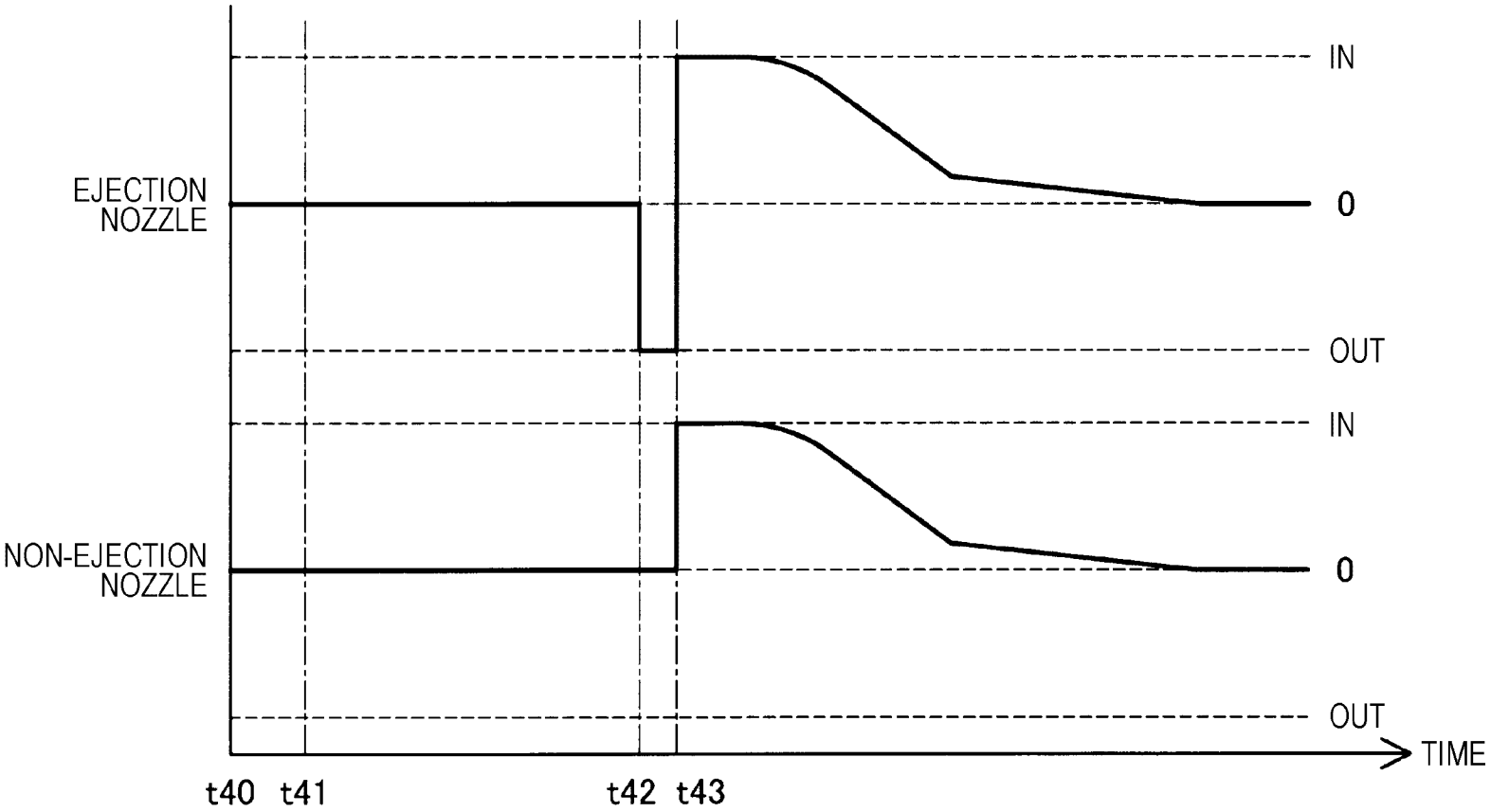
FIG. 16 is a time chart illustrating meniscus behavior in the fourth embodiment.

FIG. 15 is a time chart illustrating operations of the pressure generation element 45 in the ejection control and the non-ejection control of the present embodiment. FIG. 16 is a descriptive diagram illustrating meniscus behavior in the ejection nozzle and the non-ejection nozzle of the present embodiment.

Operations of the pressure generation element and the meniscus behavior in the ejection nozzle will be described with reference to FIGS. 14 to 16. First, in FIG. 15, a period from a timing t40 to a timing t42 corresponds to the standby process and the discharge process in FIG. 14. A period from the timing t42 to a timing t43 corresponds to the extrusion process in FIG. 14, where the control unit 90 supplies a signal of reduction so that the pressure generation element causes the pressure chamber 43 to be in the reduced state from the initial state. The timing t43 corresponds to the tail cutting process in FIG. 14, where the control unit 90 stops the supply of the signal of reduction so that the pressure generation element causes the pressure chamber 43 to return to the initial state from the reduced state. Next, in FIG. 16, in the period from the timing t40 to the timing t42 corresponding to the standby process and the discharge process, the liquid level of the ejection nozzle is formed at the leading end of the ejection nozzle. In the period from the timing t42 to the timing t43 corresponding to the extrusion process, since the liquid is ejected through the ejection nozzle, the liquid level is formed at the outer side of the ejection nozzle. At the timing t43 corresponding to the tail cutting process, since the tail cutting is performed, the air is sucked in through the ejection nozzle and the liquid level is formed at the inner side (the pressure chamber 43 side) of the ejection nozzle. Thereafter, since the supply process is started and the liquid is supplied to the ejection nozzle, the position of the liquid level gradually approaches the leading end of the ejection nozzle.

Operations of the non-pressure generation element and the meniscus behavior in the non-ejection nozzle will be described with reference to FIGS. 14 to 16. First, in FIG. 15, a period from the timing t40 to a timing t41 corresponds to the standby process in FIG. 14. The timing t41 corresponds to a start timing of the discharge process in FIG. 14, where the control unit 90 supplies the signal of expansion so that the non-pressure generation element causes the pressure chamber 43 to be in the reduced state from the initial state. The timing t43 corresponds to the tail cutting process in FIG. 14, where the control unit 90 stops the supply of the signal of reduction so that the non-pressure generation element causes the pressure chamber 43 to return to the initial state from the reduced state. Next, in FIG. 16, in the period from the timing t40 to the timing t41 corresponding to the standby process, the liquid level of the non-ejection nozzle is formed at the leading end of the non-ejection nozzle. Although the pressure chamber 43 corresponding to the non-ejection nozzle is reduced in volume at the timing t41 corresponding to the start timing of the discharge process, the liquid level of the non-ejection nozzle is not changed because the liquid in the pressure chamber 43 flows to the inflow channel 42 and the outflow channel 47. At the timing t42 corresponding to the tail cutting process, the pressure chamber 43 corresponding to the non-ejection nozzle is made to return to the initial state from the reduced state, whereby the air is sucked through the non-ejection nozzle and the liquid level is formed at the inner side (the pressure chamber 43 side) of the non-ejection nozzle. Thereafter, since the supply process is started and the liquid is supplied to the non-ejection nozzle, the position of the liquid level gradually approaches the leading end of the non-ejection nozzle.

In the above-discussed liquid ejecting apparatus 5 of the present embodiment, the control unit 90 causes the pressure chamber 43 only to be in the initial state and the reduced state in both the ejection control and the non-ejection control, and does not cause the pressure chamber 43 to be in the expanded state. With this, since the drive direction of the pressure generation element 45 is determined to be only one direction, clearance is secured with ease and the head unit 40*b* can be miniaturized.

E. Other Embodiments

Figure 17:
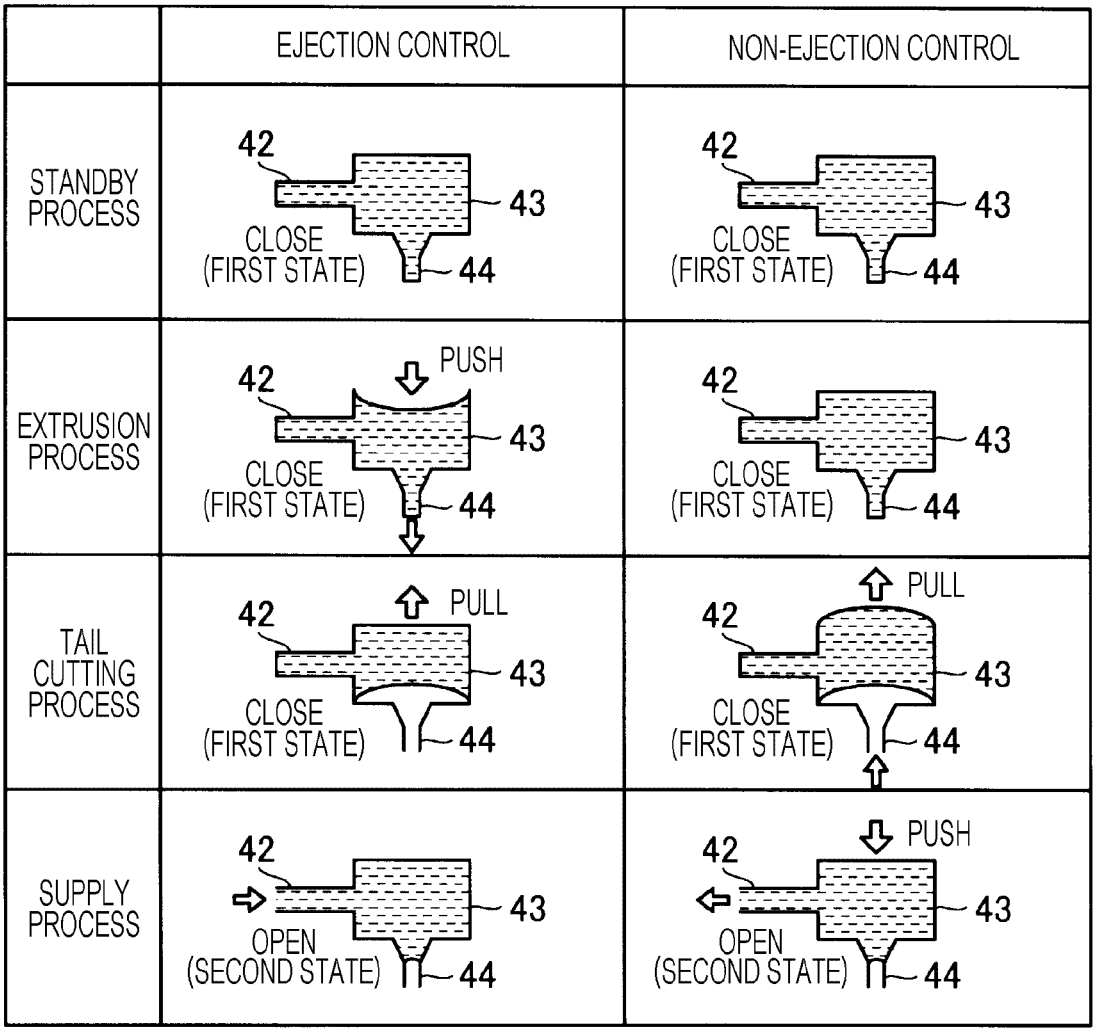
FIG. 17 is a process diagram illustrating contents of ejection control and non-ejection control in another embodiment.

E-1. In the first embodiment, the control unit 90, in the extrusion process under the non-ejection control, controls the non-pressure generation element to expand the volume of the pressure chamber 43 and cause the pressure chamber 43 to be in the expanded state. In contrast, as illustrated in FIG. 17, the control unit 90, in the tail cutting process under the non-ejection control, may control the non-pressure generation element to expand the volume of the pressure chamber 43 and cause the pressure chamber 43 to be in the expanded state.

E-2. By combining the second and third embodiments and using the head unit 40*b* provided with the outflow channel 47, the ejection control and the non-ejection control of the second embodiment may be carried out. In this case, in the standby process, the outflow channel 47 is made to be in the fourth state in which the channel resistance is small, while in the processes other than the standby process, the outflow channel 47 is made to be in the third state in which the channel resistance is large.

E-3. The first channel resistance changing section 51 in each of the above-described embodiments is in a mode in which the first rod 52 closes the inflow channel 42. In contrast, the first channel resistance changing section 51 may be constituted of a plate having a through-hole therein, and may be in a mode in which the plate is driven to make a sliding movement on an inner wall surface of the common supply liquid chamber 41, whereby an area where the through-hole overlaps with an opening of the inflow channel 42 inside the common supply liquid chamber 41 is changed so that the channel resistance of the inflow channel 42 is changed. Further, the above-discussed first channel resistance changing section 51 may not be provided inside the common supply liquid chamber 41, but may be provided halfway in the inflow channel 42; in this case, it may be in a mode in which a cross-sectional area of the inflow channel 42 is changed.

E-4. The second channel resistance changing section 61 in each of the above-described embodiments is in the same mode as that of the first channel resistance changing section 51. In contrast, the second channel resistance changing section 61 may be in a different mode from the mode of the first channel resistance changing section 51. In this case, the second channel resistance changing section 61 may employ various kinds of modes such as a mode in which the second channel resistance changing section 61 is constituted of a plate having a through-hole as mentioned above.

E-5. Although the pressure generation element 45 in each of the above embodiments is described as a piezoelectric element, the pressure generation element 45 is not limited to the piezoelectric element, and it is sufficient for the pressure generation element 45 to be an element in a mode capable of causing the liquid to be ejected through the nozzle 44 by generating a change in pressure in the pressure chamber 43. For example, the pressure generation element 45 may be an element in a mode in which a lever is driven in response to expansion and reduction of air bubbles so that the vibration plate 46 is pushed and pulled by the driving of the lever, whereby the volume of the pressure chamber 43 is changed to generate a change in pressure in the pressure chamber 43. In addition, a mode using a magnetostrictor in place of the piezoelectric element may be employed, or a mode in which the vibration plate 46 is displaced by using electrostatic force may be employed.

E-6. In the head unit 40 in each of the above embodiments, the pressure generation elements 45 are provided for all the pressure chambers 43. In contrast, the head unit 40 may include, of the plurality of pressure chambers 43, some pressure chambers 43 for which the pressure generation elements 45 are not provided.

E-7. The invention can be applied not only to a liquid ejecting apparatus configured to eject ink, but also to an arbitrary liquid ejecting apparatus configured to eject another liquid other than ink. For example, the invention can be applied to various kinds of liquid ejecting apparatuses as cited below.

1. An image recording apparatus such as a facsimile apparatus.
2. A coloring material ejecting apparatus used in the manufacture of a color filter for an image display device such as a liquid crystal display.
3. An electrode material ejecting apparatus used in the formation of electrodes of an organic EL (electro luminescence) display, a field emission display (FED), and the like.
4. A liquid ejecting apparatus configured to eject a liquid containing bioorganic material used in the manufacture of biochips.
5. A specimen ejecting apparatus as a precision pipette.
6. A lubricant-oil ejecting apparatus.
7. A resin-liquid ejecting apparatus.
8. A liquid ejecting apparatus configured to perform pinpoint ejection of a lubricant oil into a precision machine such as a watch and a camera.
9. A liquid ejecting apparatus configured to eject, onto a substrate, a transparent resin liquid such as an ultraviolet curing resin liquid in order to form miniature hemispheric lenses (optical lenses) for use in optical communication elements.
10. A liquid ejecting apparatus configured to eject an etching liquid of acid or alkali onto a substrate or the like for etching.
11. A liquid ejecting apparatus including a liquid ejecting head configured to eject a tiny amount of other arbitrary droplets.

Note that the "droplet" refers to a state of liquid ejected from a liquid ejecting apparatus, and includes a granule form, a teardrop form, and a form that pulls a tail in a string-like shape therebehind. In addition, it is sufficient that the "liquid" described here is a material which the liquid ejecting apparatus can consume. For example, it is sufficient for the "liquid" to be a material in which a substance is in a state of liquid phase, and the following liquid materials are also included in the "liquid": a liquid material having high or low viscosity, sol, gel water, other inorganic solvents, an organic solvent, a solution, a liquid resin, and a liquid metal (metallic solution). Furthermore, in addition to the liquid as one state of a substance, materials in which the particles of a functional material made of a solid material such as pigments, metal particles, or the like are dissolved, dispersed or mixed in a solvent are also included in the "liquid". As typical examples of the liquid, ink, liquid crystal, and the like can be cited. Here, "ink" includes general water-based and oil-based ink, and various types of liquid compositions such as gel ink and hot-melt ink.

The invention is not limited to the above-described embodiments, and can be implemented in various configurations without departing from the spirit and scope of the invention. For example, the technical features in the embodiments corresponding to the technical features in the aspects described in the section of summary of the invention can be appropriately replaced, combined, or the like with each other in order to solve part of or all of the above-mentioned problems, or to achieve part of or all of the above-mentioned effects. Further, unless the stated technical features are described as absolutely necessary in the present specification, they can be appropriately removed.

The entire disclosure of Japanese Patent Application No.: 2017-227395, filed Nov. 28, 2017 is expressly incorporated by reference herein.

What is claimed is:

1. A liquid ejecting apparatus comprising:

a plurality of nozzles for ejecting a liquid;

a plurality of pressure chambers communicating with the nozzles;

a plurality of pressure generation elements provided on the plurality of pressure chambers and configured to change volumes of the pressure chambers;

a plurality of inflow channels connected to the pressure chambers and configured to allow the liquid to enter the pressure chambers, each of the plurality of nozzles corresponding to one of the plurality of pressure chambers, one of the pressure generation elements, and one of the plurality of inflow channels;

a first channel resistance changing section configured to collectively change channel resistance of each of the inflow channels;

a pressurizing unit configured to pressurize and supply the liquid to the inflow channels; and a control unit configured to control the first channel resistance changing section and each of the plurality of pressure generation elements to cause at least one of the plurality of nozzles to be an ejection nozzle, and to cause at least one of the plurality of nozzles to be a non-ejection nozzle, wherein:

the control unit repeats control of switching between a first state in which the control unit controls the first channel resistance changing section to collectively increase the channel resistance of the plurality of inflow channels and a second state in which the control unit controls the first channel resistance changing section to collectively make the channel resistance of the plurality of inflow channels smaller than the channel resistance of the plurality of inflow channels in the first state; and for each of the at least one ejection nozzle, the control unit causes the corresponding pressure generation element to reduce the volume of the corresponding pressure chamber in the first state, such that the liquid in the corresponding pressure chamber is caused to be ejected out of the ejection nozzle, and for each of the at least one non-ejection nozzle, the control unit causes the corresponding pressure generation element to expand the volume of the pressure chamber in the first state, and to reduce the volume of the pressure chamber in the second state, such that the liquid in the corresponding pressure chamber is caused to flow back to the corresponding inflow channel.

2. The liquid ejecting apparatus according to claim 1, wherein the control unit expands the volume of the pressure chamber corresponding to the non-ejection nozzle in the non-ejection control, after having reduced the volume of the pressure chamber corresponding to the ejection nozzle in the ejection control.

3. The liquid ejecting apparatus according to claim 1, wherein the control unit, when performing the ejection control and the non-ejection control, switches twice from the first state to the second state;

the control unit controls, in the ejection control, the pressure generation element to expand the volume of the pressure chamber in the earlier first state prior to the extrusion control and performs the extrusion control in the later first state; and the control unit performs, in the non-ejection control, the intake and exhaust control in a period of time from the earlier first state to the earlier second state and performs the intake and exhaust control again in a period of time from the later first state to the later second state.

4. The liquid ejecting apparatus according to claim 1, further comprising:

a plurality of outflow channels connected to the pressure chambers and configured to allow the liquid to flow out from the pressure chambers; and a second channel resistance changing section to collectively change channel resistance of each of the outflow channels, wherein the control unit repeats control of switching between a third state in which the control unit controls the second channel resistance changing section to collectively increase the channel resistance of the plurality of outflow channels and a fourth state in which the control unit controls the second channel resistance changing section to collectively make the channel resistance of the plurality of outflow channels smaller than the channel resistance of the plurality of outflow channels in the third state.

5. The liquid ejecting apparatus according to claim 4, wherein the control unit controls, in the ejection control, the pressure generation element to reduce the volume of the pressure chamber at the timings of the first state and the third state; and in the non-ejection control, the control unit controls the non-pressure generation element to expand the volume of the pressure chamber at the timings of the first state and the third state, and controls the non-pressure generation element to reduce the volume of the pressure chamber at the timing of the second or fourth state.

6. The liquid ejecting apparatus according to claim 1, wherein the control unit can output a signal of expansion to the pressure generation element to make the volume of the pressure chamber be in an expanded state, and a signal of reduction to the pressure generation element to make the volume of the pressure chamber be in a reduced state; and the control unit causes the volume of the pressure chamber to be expanded by supplying the signal of expansion to the pressure generation element or by stopping the supply of the signal of reduction to the pressure generation element, and causes the volume of the pressure chamber to be reduced by supplying the signal of reduction to the pressure generation element or by stopping the supply of the signal of expansion to the pressure generation element.

7. A liquid ejecting apparatus comprising:

a first nozzle for ejecting a liquid;

a first pressure chamber fluidly communicating with the first nozzle;

a first actuator provided on the first pressure chamber and configured to change a volume of the first pressure chamber;

a first inflow channel fluidly connected to the first pressure chamber and configured to allow the liquid to enter the first pressure chamber;

a second nozzle for ejecting the liquid;

a second pressure chamber fluidly communicating with the second nozzle;

a second actuator provided on the second pressure chamber and configured to change a volume of the second pressure chamber;

a second inflow channel fluidly connected to the second pressure chamber and configured to allow the liquid to enter the second pressure chamber;

a first valve to collectively change channel resistance of the first inflow channel and second inflow channel;

a pump configured to pressurize the liquid that supplied to the first inflow channel and the second inflow channel;

a CPU; and a memory having stored thereon machine-readable instructions that are structured such that, when executed by the CPU, the machine-readable instructions cause the liquid ejecting apparatus to perform at least the following:

increasing channel resistance of the first inflow channel and second inflow channel by the first valve, decreasing the volume of the first pressure chamber by the first actuator to eject the liquid from the first nozzle, at a same time when the first actuator is decreasing the volume of the first pressure chamber, increasing the volume of the second pressure chamber by the second actuator to prevent the second nozzle from ejecting the liquid, and decreasing channel resistance of the first inflow channel and second inflow channel by the first valve.

* * * * *